US008360247B2

(12) United States Patent
Baker

(10) Patent No.: US 8,360,247 B2
(45) Date of Patent: Jan. 29, 2013

(54) MAGNETIC SEPARATION APPARATUS

(76) Inventor: William John Baker, Thirroul (AU)

( * ) Notice: Subject to any disclaimer, the term of this patent is extended or adjusted under 35 U.S.C. 154(b) by 0 days.

(21) Appl. No.: 12/937,230

(22) PCT Filed: Apr. 8, 2009

(86) PCT No.: PCT/AU2009/000424

§ 371 (c)(1),
(2), (4) Date: May 12, 2011

(87) PCT Pub. No.: WO2009/124342

PCT Pub. Date: Oct. 15, 2009

(65) Prior Publication Data

US 2011/0203976 A1 Aug. 25, 2011

(30) Foreign Application Priority Data

Apr. 8, 2008 (AU) ..... 2008100307
Apr. 9, 2008 (AU) ..... 2008100315
Oct. 31, 2008 (AU) ..... 2008905621

(51) Int. Cl.
*B03C 1/00* (2006.01)

(52) U.S. Cl. ..... 209/223.1; 209/223.2; 209/224; 209/228; 209/229; 209/232

(58) Field of Classification Search ..... 209/214, 209/223.1, 223.2, 224, 228, 229, 232
See application file for complete search history.

(56) References Cited

U.S. PATENT DOCUMENTS 4,457,838 A * 7/1984 Carr ..... 209/223.2
5,066,390 A * 11/1991 Rhodes et al. ..... 209/217
5,190,159 A * 3/1993 Barker ..... 209/223.2
5,427,249 A * 6/1995 Schaaf ..... 209/223.2
6,250,475 B1 * 6/2001 Kwasniewicz et al. ..... 209/229
6,902,066 B2 * 6/2005 Yang ..... 209/223.1
7,073,668 B2 * 7/2006 Alford et al. ..... 209/216
2006/0201887 A1 9/2006 Siddiqi

FOREIGN PATENT DOCUMENTS

FR 2484128 A1 12/1981
GB 241564 A 2/1926
JP 0811763 5/1996

OTHER PUBLICATIONS

International Search Report for International Patent Application No. PCT/AU2009/000424, dated Jun. 12, 2009.

* cited by examiner

*Primary Examiner* — Terrell Matthews
(74) *Attorney, Agent, or Firm* — Patterson & Sheridan, L.L.P

(57) ABSTRACT

A magnetic separation apparatus (10) for separating magnetic materials from non-magnetic materials in a material flow comprising self cleaning magnetic separators (15) comprising: a cylinder (20) having a first end closer to a material flow than its second end in use, a piston (25) slidingly mounted within the cylinder (20), and a magnetic shaft (30) extending from the piston (25), the piston (25) and cylinder (20) adapted to move the magnetic shaft (30) between an extended position (31) and a retracted position (32), such that in the extended position (32), at least a sleeveless portion of an outer surface of the magnetic shaft (30) is exposed to the material flow and in the retracted position the magnetic portion is retracted substantially or wholly within the cylinder (20), the apparatus including a protected shaft wiper (120) and shaft seal (125) within the first end of the cylinder (20) for removing extracted magnetics.

25 Claims, 10 Drawing Sheets

MAGNETIC SEPARATION APPARATUS

BACKGROUND OF THE INVENTION

1. Field of the Invention

The present invention relates to a magnetic separation apparatus for separating magnetic materials from non-magnetic materials in a material flow.

2. Description of the Related Art

Magnetic separators are used in many processing industries to remove ferrous and para-magnetic contamination from products and production lines, particularly in grain, food and chemical industries. Such contamination may arise in the form of metal fragments, staples and nails from packaging, nuts and bolts from processing machinery, wear and tear from moving frictional parts, magnetic stone and/or rust which could potentially cause production machinery damage or product contamination.

Magnetic separators are available in the form of racks of magnetic bars (sometimes also called rods or tubes) that are pulled or pushed through cleaning glands. Such racks are generally large and relatively heavy, and require large forces to actuate. Thus, most magnetic grate separators with power assisted magnet cleaning, have either one relatively large pneumatic cylinder or two or more relatively small pneumatic cylinders that are adapted to operate in sync to move a rack of magnetic bars. The use of a single large cylinder to push or pull a grate magnet through a rack of cleaning glands from the front or rear increases the size and bulkiness of the machinery and requires more space, which may be unavailable or inefficient in a production plant. It is also typically difficult to correctly synchronise the actuation of two or more smaller cylinders to push or pull a grate magnet through a rack of cleaning glands, especially if unevenly distributed loads occur. If synchronicity is not achieved, the rack encounters different resistance on each side, which tends to cause a "walking" or jerking effect. Uneven or jerky actuation may also be caused by the condensation of hygroscopic products, such as sugar, on the bars of the rack.

U.S. Pat. No. 5,190,159 describes a magnetic separator which requires a front and rear walled ferrous magnetics discharge chamber and a cleaning mechanism in the form of an independent "floating" annular wiper bushing disposed on a magnetic bar. The annular wiper bushing is adapted to move with the magnetic bar on which it is disposed within the walls of the said fixed magnetics discharge chamber and to move relative to the bar and wipe ferrous material off the magnetic bar as the bar is moved through the said magnetics discharge chamber.

Other prior art requires an independent cleaning annular wiping bushing to be attached to a bulk head or to one wall of a fixed magnetics discharge chamber. Magnet cleaning is effected as the magnet is moved through the magnetics chamber or bulk head to which the wiper bushing is attached.

Although prior art provides a magnetic separator which is cylinder and piston actuated, the magnetic tube, rod or bars are independently connected to the cylinder and its conventional non magnetic shaft.

In other prior art such as NIPPON 06284070 or PROGLAVA FR2848128 (A1), magnetic separation occurs when material flow is in contact or close contact with a stationery sleeve or tube inside which the array of magnets is free to move slidingly. The inner magnets are distanced from the material contact surface by the sleeve plus the clearance between the sleeve and the inner magnets which reduces the available magnetic force. Cleaning is effected as the inner magnet is withdrawn past the baffle or other cleaning means imposed, or attached to the sleeve.

The present invention seeks to provide a magnetic separation apparatus which will overcome or substantially ameliorate at least some of the deficiencies of the prior art, or to at least provide an alternative.

The present invention seeks to provide a self contained magnetic separation module which in order to function as such including in a self cleaning manner, does not require any external, additional or separate means of actuation other than the components which comprise a shaft piston cylinder and shaft seal device known as a pneumatic or hydraulic cylinder.

The present invention seeks to provide a self cleaning self contained magnetic separation module as herein before described which in order to function as a self cleaning magnetic separator does not require shaft wiping glands or wiping means external to the essential components of the device known as a pneumatic or hydraulic cylinder.

The present invention seeks to provide a magnetic separation device which is simpler with less components and which incorporates features herein before described which provide improvements over prior art by eliminating the otherwise essential need for bulk head or front and rear walled magnetics chambers, thus reducing manufacturing cost and eliminating the need for conventional fixed bar centres as is common to prior art self cleaning and non self cleaning grate type magnets. The present invention contrives to introduce incremental rotation of each bar of a grate magnet system and to provide the means to withdraw and extend the or each magnet bar separately into and out of a product stream thereby providing a range of contingencies against tendency of difficult material to bridge over conventional prior art grate type magnetic separators.

Further, the present invention seeks to provide a means of self cleaning high powered magnetic separation which is not dependent on moving an array of magnets inside a sleeve or tube which is in contact with a material flow. Sleeves are essential to many quick or self cleaning grate type and single element separating magnets of prior art including the NIPPON or PROGLAVA inventions herein before mentioned. The use of sleeves is not desirable as magnetism decreases on "inverse square law". The introduction of a sleeve for wear resistance or to permit magnet cleaning substantially reduces the potential flux density required for extraction of modern day magnetic contamination of concern such as fragments of low magnetic susceptibility, like work hardened SS fragments and magnetic stone. Therefore the present invention substantially increases the potential magnetic separation efficiency.

The present invention seeks to provide a modular and self contained, self powered high strength rare earth magnetic separation apparatus which is also readily adapted to housings of various configurations.

It is the object of the present invention to substantially overcome or at least ameliorate one or more of the prior art disadvantages or at least provide a useful alternative.

It is to be understood that, if any prior art information is referred to herein, such reference does not constitute an admission that the information forms a part of the common general knowledge in the art, in Australia or any other country.

SUMMARY OF THE INVENTION

According to a first aspect, the present invention provides a magnetic separation apparatus for separating magnetic materials from non-magnetic materials in a material flow, the apparatus comprising at least one magnetic separator, each magnetic separator comprising:

a cylinder, having a first end and a second end, the first end being closer to the material flow than the second end in use, a piston movably mounted within the cylinder, and a magnetic shaft extending from the piston and having an outer surface, a proximal end and a distal end, the piston being adapted to move the magnetic shaft between a retracted position at which the magnetic shaft is substantially wholly disposed within the cylinder, and an extended position at which the magnetic shaft extends from the cylinder first end, wherein in the extended position, at least a portion of the magnetic shaft outer surface is exposed to the material flow.

Preferred embodiments of the present invention will now be described.

The apparatus preferably comprises a plurality of magnetic separators, each magnetic separator being operable independently of the other magnetic separators in moving their respective magnetic shaft between its extended and retracted positions.

In a preferred embodiment, the magnetic separators are arranged such that the magnetic shafts are substantially parallel to each other and/or located in the same plane.

In a preferred embodiment, the apparatus further comprises a support to which each cylinder is mounted, the support having a first wall separating the cylinder of each magnetic separator from the material flow in use, the first wall having a respective aperture for the magnetic shaft of each magnetic separator such that each magnetic shaft extends through its respective support aperture as it moves between the retracted and extended positions.

In this embodiment, the apparatus preferably further comprises a cleaning means for removing magnetic material attracted to the outer surface of each magnetic shaft.

The cleaning means preferably removes the magnetic material during movement of each magnetic shaft from its extended position to its retracted position.

The cleaning means preferably comprises a wiping lip for each shaft, each wiping lip defining a wiping aperture through which the respective shaft extends, the wiping aperture being dimensioned such that the wiping lip engages the outer surface of the magnetic shaft, wherein magnetic material adhered to the outer surface of the shaft is substantially wiped off the shaft by the wiping lip causing the magnetic material to fall as the magnetic shaft moves to its retracted position, wherein each cleaning means is fixed or magnetically attracted to the first wall.

In one embodiment, the support defines a housing having said first wall, the housing defining a material flow section and a magnetic materials collection section disposed between the material flow section and the first wall.

In this embodiment, the apparatus preferably further comprises a separation wall separating the magnetic materials collection section from the material flow section, the separation wall having a respective separation wall aperture for the shaft of each magnetic separator such that each magnetic shaft extends through its respective separation wall aperture as it is moved between the retracted and extended positions.

In this embodiment, the apparatus preferably further comprises a cleaning means for removing magnetic material attracted to the outer surface of each magnetic shaft, and wherein the cleaning means is located within or adjacent to the magnetic materials collection section.

In this embodiment, the cleaning means preferably comprises a wiping lip for each shaft, each wiping lip defining a wiper aperture through which the respective shaft extends, the wiper aperture being dimensioned such that the wiping lip engages the outer surface of the magnetic shaft, wherein magnetic material adhered to the outer surface of the shaft is substantially wiped off the shaft by the wiping lip causing the magnetic material to fall as the magnetic shaft moves to its retracted position.

In this embodiment, the apparatus preferably further comprises a wiper supporting ring disposed around the wiping lip, wherein each wiper supporting ring is larger than the respective housing and separation wall apertures of the respective shaft, such that as each shaft is moved to its extended position, its respective wiping means moves with the shaft until the wiper supporting ring abuts the separation wall, whereupon the shaft slides through the respective wiper aperture and into the material flow section, and as each shaft is moved to its retracted position, its respective wiping means moves with the shaft until the wiper supporting ring abuts the first wall, whereupon the shaft slides through the respective wiper aperture and into the cylinder.

The wiper supporting ring preferably substantially seals the magnetic materials collection section from the material flow section when the wiper supporting ring abuts the separation wall.

In this embodiment, the distal end of each shaft preferably has a disc removably fitted thereto, such that when the shaft is in the retracted position, the disc extends across and closes its respective separation wall aperture.

In one embodiment, the present invention further comprises a cleaning means for removing magnetic material attracted to the outer surface of each magnetic shaft.

In one embodiment, the cleaning means preferably further comprises a pressurised gas delivery means, the pressurised gas delivery means having at least one output nozzle for directing pressurised gas at the outer surface of each magnetic shaft, and a respective gas duct for conveying pressurised gas to each nozzle.

In one embodiment, at least one of the gas ducts conveys pressurised gas expelled from one of the cylinders during movement of the shaft between its extended and retracted positions.

In this embodiment, at least one of the gas ducts preferably conveys pressurised gas from an external pressurised gas source.

In one embodiment, each magnetic separator further comprises a rotation means adapted to incrementally rotate the magnetic shaft about its longitudinal axis.

In this embodiment, the rotation means is preferably adapted to rotate the magnetic shaft by an angular increment during movement of the shaft from its extended position to its retracted position and/or from its retracted position to its extended position.

In this embodiment, the rotation means is preferably a cam mechanism comprising a cam engagement means disposed on the outer surface of the magnetic shaft, and a cam track disposed within the respective cylinder, and the shaft is movable longitudinally relative to the cam engagement means, the cam engagement means being rotatable in a first rotation direction relative to the magnetic shaft and being rotationally fixed relative to the magnetic shaft in an opposite second direction, the cam engagement means adapted to engage the cam track, such that during movement of the magnetic shaft between its retracted and extended positions, the cam engagement means is engaged by the cam track for a predetermined period toward the second direction which causes the magnetic shaft to rotate by an angular increment in the same direction as the cam track.

In one embodiment, the present invention further comprises a respective shaft support means for supporting the weight of each shaft when in the extended position.

In this embodiment, the shaft support means preferably comprises a transverse support bar that supports the distal end of the shaft.

In one embodiment, a distal region of each shaft is non-magnetic.

According to a second aspect, the present invention provides a method of separating magnetic materials from non-magnetic materials in a material flow using a magnetic separator having a cylinder, a piston movably mounted within the cylinder and a magnetic shaft extending from the piston, the piston being adapted to move the magnetic shaft between a retracted position at which the magnetic shaft is substantially wholly disposed within the cylinder, and an extended position at which the magnetic shaft extends from the cylinder, the method including the steps of:

extending the magnetic shaft into the material flow via the piston such that at least a portion of the magnetic shaft outer surface is exposed to the material flow; and retracting the magnetic shaft from the material flow into the cylinder.

In one embodiment, the method preferably further comprises the step of:

wiping the magnetic shaft as it is being retracted into the cylinder to substantially remove any magnetic material adhered to its outer surface.

In one embodiment, the method preferably further comprises the step of:

rotating the magnetic shaft along its longitudinal axis by an angular increment as it is being extended and/or retracted.

Other preferred aspects and embodiments of the present invention will now be described.

In the preferred embodiment described herein, in the extended position, the portion of the outer surface of each magnetic shaft directly exposed to the material flow magnetically attracts magnetic material interspersed within the material flow and extracts such magnetic material from the material flow. The magnetic shaft of each cylinder then automatically cleans itself as it retracts back into the cylinder and is thereby cleaned of its magnetic collections away from the material flow, preventing re-contamination of the material flow, or in embodiments with a housing, cleaning occurs as the magnetic shaft is retracted through the independent cleaning wiper located in the magnetics material collection section where it becomes sheltered from the material flow for cleaning.

Whether in single or multiple parallel grate type configurations, the magnetic shafts with respective cylinders are safer, as when cleaned or not in use there are less pinch points. There is also more protection and less exposure of high powered magnets and more protection of the magnets against damage. Expensive guards and covers are also avoided thereby.

Preferably, each cylinder can be mounted adjustably such that its magnetic shaft is at any one of various angles and at various centres in relation to a material flow which may be liquid or free flowing dry materials. This flexibility in mounting permits optimized magnetic coverage of the material flow with minimized flow problems when processing materials which tend to block or bridge. Advantageously, a fixed bulk head or multi walled magnetics chamber is not essential to enable the apparatus to be self cleaning, hence such bulk head or multi walled chamber of the prior art can be eliminated. Profiled holes at fixed centres in front and rear or either walls of a bulk head or chamber can also often be eliminated with the embodiments of the present invention not requiring a housing in order to function as a self cleaning magnetic separator.

Pneumatic or hydraulic actuation is the preferred method of moving the magnetic shaft between extended and retracted positions and keeping it supported during the movement. Preferably, the apparatus is adapted to pneumatically or hydraulically actuate the piston of each magnetic separator.

Preferably, each magnetic shaft is releasably attached to its respective piston. Advantageously, each magnetic shaft may be readily detached from the magnetic separator, which may be useful for servicing. Notwithstanding, the removable magnetic shaft is preferably adapted to have a left or right hand threaded connection into the piston so as to be self tightening and not self loosening as a result of the abrupt incremental turning which is imposed by the turning mechanism incorporated into the cylinder in one of the preferred embodiments.

In the embodiment with the housing, the magnetic shafts are preferably substantially contained within the housing when in use and substantially within the cylinder when not in use. This is desirable to protect the moving components, prevent further contamination of the material, prevent operator injury and reduce material waste.

In the embodiment with the separation wall, the magnetic materials collection section and the material flow section are physically separated, allowing the cleaned flowing material and the removed magnetic materials to be separately collected. This can reduce recontamination of the flowing material and the amount of material wastage, which may otherwise arise by the flowing material falling into the magnetic materials collection section.

Advantageously, when the apparatus is not in use and each magnetic shaft is in the retracted position, all of the separation wall apertures in the preferred embodiment may be closed and/or sealed.

In some embodiments comprising a housing, the separation wall is relatively low such that a top edge of the separation wall does not extend across the path of each magnetic shaft.

Advantageously, this provides an 'open-chamber' design, in which the magnetic materials collection section and the material flow section are separated within the housing, but are not completely isolated from each other. This design has an advantage over one that completely isolates the sections if, in addition to containing fine magnetic material, the material flow contains larger tramp iron and magnetic particles. Large pieces of magnetic material adhered to each shaft may not be able to pass unhindered through the separation wall apertures and may instead be pushed back into the material flow upon retraction of the shaft.

The provision of a shorter separation wall, however, ensures that the majority of falling magnetic materials are directed into the magnetic materials collection section without falling back into the material flow.

Preferably, the separation wall in this embodiment is disposed at an angle leaning towards the first wall.

Preferably, a top portion of the separation wall in this embodiment is orientated at an angle leaning towards the first wall.

Advantageously, the separation wall maintains the material flow within and redirects any stray material back into the material flow section. This also prevents any magnetic materials falling astray or bouncing off a wall or other surface within the magnetic material collection sections from rejoining and recontaminating the material flow.

Alternatively, a top portion of the separation wall is orientated parallel to the first wall.

Alternatively, a top portion of the separation wall is orientated at an angle leaning away from the first wall.

Advantageously, any stray magnetic materials that fall on the top portion of the separation wall will be redirected back into the magnetic material collection section.

Advantageously, in a preferred embodiment having the wiping lip, the wiping lip provides effective wiping and the wiper supporting ring provides strength and rigidity to the wiping means.

Preferably, the wiping lip is made of a thermosetting plastic.

Advantageously, thermosetting plastic is an extremely wear resistant material that is hard and produces little friction.

Advantageously, in one embodiment, a movable wiping means is provided that remains on the respective shaft at all times during operation but that is able to be moved along the shaft. This removes the potential for aperture misalignment, which may arise if the wiping means is fixed to the first wall especially as the wiper aperture needs to be a relatively tightly fit to the respective shaft for effective cleaning. Furthermore, the wiping means allows each shaft to be cleaned individually. As it requires less force to actuate a single shaft through a tight aperture than to actuate an entire rack of bars through a number of tight apertures, individual cleaning requires less force than collective cleaning and thus the size of each piston may be correspondingly small, which saves space.

Preferably, in embodiments having the separation wall, when the apparatus is no longer used and the materials flow section is to be used to convey another material not requiring magnetic separation and after all shafts are in the retracted position, the apparatus can be controlled so that a partial extension stroke makes the tight wiping means shut off all the separation wall apertures from within the magnetic collection section until the apparatus is next used.

Preferably in another housing embodiment, a disc removably mounted on the distal end of each magnetic shaft is adapted to close off the material chamber from the magnetics chamber when the magnetic shaft is retracted. Advantageously, this enables both chambers in the housing to be sealed from each other when other materials not requiring magnetic separation are being processed.

In embodiments having a pressurized fluid delivery means, some of the output nozzles may be directed to blow pressurised gas at the separation wall apertures such that any material from the material flow that may otherwise enter the magnetic material collection section through the separation wall apertures is blown back into the material flow section. This may occur during the retraction stroke as material may build up on a top portion of each shaft, or as a result of the material bouncing off the shaft. Thus, the use of a directed nozzle reduces material wastage.

Advantageously, the output nozzles may be arranged to direct pressurised fluid, such as air or water, onto each shaft. This may be particularly useful in removing magnetic material from the top of a non-magnetic portion at the distal end of each shaft, before it returns into the material flow area. Furthermore, the output nozzles may be arranged to direct pressurised fluid towards the one or more positions along the magnetic shaft where it begins to retract away from the extremity of the material flow area and approach the magnetic materials collection area or in housing embodiments, approach the separation wall apertures such that any material from the material flow that may otherwise enter the materials collection area or the magnetic material collection sections through the separation wall apertures is blown back into the material flow section. This may occur during the retraction stroke as material may build up on a top portion of each shaft, or as a result of the material bouncing off the or each shaft. Thus, the use of directed nozzles prevents recontamination and reduces material wastage.

In one embodiment, the cylinder will be powered by air or water to reduce possibility of product contamination in the food industry.

Advantageously, air will be used to direct non magnetic dry products back into the material flow during a retraction stroke and prevent magnetics remaining on the non magnetic distal end of the magnetic shaft from riding back into the material flow during an extension stroke.

Alternatively, water will be used to direct non magnetic liquid products back into the material flow during a retraction stroke and prevent magnetics remaining on the non magnetic distal end of the magnetic shaft from riding back into the material flow during an extension stroke.

In the embodiments having rotation means, material from the material flow that may otherwise build up on the top portion of each shaft when the shaft is exposed to the material flow may be abruptly substantially removed by rotation. Furthermore, rotation ensures that the wear of each shaft caused by the mechanical abrasion of the material in the material flow is evenly distributed around the shaft. Excessive wear of each shaft usually results in breakage or the discharge of components or magnetic wear particles into the material stream. If each shaft is not evenly worn because only one portion of the outer surface of each shaft is exposed to the material flow during the extension stroke and in operation, excessive wear will occur only on that portion and each shaft will require replacement sooner, which is both inconvenient and costly. Furthermore, uneven or localised wear may prevent effective cleaning by the cylinder seal or the wiper system and cause premature damage to the wiping means Excessive abrasion on a particular portion of each shaft may allow oxygen penetration to prematurely reduce the magnetism of each shaft due to oxidisation or corrosion by even minimal exposure of inner rare earth magnets which are very prone to oxidation and corrosion.

Advantageously, material from the material flow that has built up along the top portion of the or each shaft may be shifted by an abrupt rotation by an angular increment at the commencement of each retraction stroke, allowing such product to fall off the magnetic shaft while it is substantially still in the material flow area.

Advantageously, non-adherent magnetic material located on a top portion of the or each shaft may be shifted and deposited in the area outside the material flow or in the housing adaptations, outside the respective magnetic material collection section by an abrupt rotation by an angular increment at the commencement of each extension stroke. This is particularly useful in removing any remaining magnetic material from the top of the non-magnetic portion at the distal end of the or each shaft, when the magnetic portion of the shaft has retracted into the pneumatic or water powered cylinder, or has passed through the respective wiping means. If self or power assisted grate magnet bars are not rotated such magnetics although separated once will ride back on top of the non magnetic distal end of each shaft or bar and be reintroduced into the product.

In the preferred embodiment, a motor is not required for rotating the shaft, reducing manufacturing, operational and maintenance costs. Instead, the cam mechanism redirects the motion of the shaft and converts the axial motion of each shaft as provided by the pneumatic or fluid actuation into rotation by an angular increment at the commencement of a stroke.

Preferably, the cam engagement means comprises a sprag clutch having cam pins, cam rollers, cam bearings or robust free bearings.

Advantageously, a sprag clutch is an effective and reliable method of allowing the spiral cam engagement means to rotate in one direction. Cam pins, cam rollers, cam bearings and robust free bearings are also effective and reliable methods of engaging the spiral cam engagement means with the spiral cam track.

When each shaft is in the extended position and is maximally exposed to the material flow, the weight of the material falling on the or each shaft may be quite substantial. If the shaft is relatively long, the combined weight of each shaft and the falling material may impose a large moment on each shaft. Thus, the shaft support means advantageously supports this combined weight, preventing each shaft from bending.

Preferably, the shaft support means comprises a transverse support bar that supports the distal end of the shaft of each magnetic separator in use.

Advantageously, a transverse support bar is an effective method of providing support at the distal end of each shaft.

Advantageously, the magnetic separation apparatus comprises a plurality of magnetic separators and removes a large amount of the magnetic materials from the material flow. For example, if a horizontal array of two or more rows of magnetic separators is provided, a greater amount of the magnetic material may be removed and the resultant material flow will contain less magnetic contaminants. Preferably, only one of the two or more magnetic shafts of the respective two or more magnetic separators is adapted to be retracted from the material flow at a time, such that magnetic separation coverage across the material stream is provided on a continuous basis.

Advantageously, the force required to actuate each magnetic separator individually is less than the force required to actuate a plurality of magnetic separators simultaneously. Thus, smaller pistons may be provided and the cleaning of the magnetic materials from each shaft is more effective. Furthermore, this allows the magnetic material separation to be continuously provided.

In the preferred embodiment the method of separating magnetic materials from non-magnetic materials in a material flow comprises:

providing a magnetic separator having a highly magnetic shaft instead of a conventional cylinder shaft the magnetic shaft being mounted to the piston of the cylinder and piston type actuator;

extending the magnetic shaft into the material flow by use of the cylinder and piston type actuator in an extension stroke; and retracting the magnetic shaft from the material flow by use of the cylinder and piston type actuator in a retraction stroke to complete a single cycle.

Advantageously, a piston and cylinder type actuator is an effective method of directly actuating the magnetic shaft mounted thereto between an extended and a retracted position without intermediate apparatus being essential. In the extended position, any magnetic material that is interspersed within the magnetic flow is attracted towards the portion of an outer surface of the magnetic shaft that is exposed to the material flow. The magnetic shaft may then be retracted to remove the magnetic material from the material flow and to shelter it from the material flow for cleaning, storage or other purposes.

Preferably, the method of separating magnetic materials from non-magnetic materials in a material flow further comprises the step of:

wiping the magnetic shaft as it retracts into the cylinder or during the retraction stroke to substantially remove any magnetic material adhered to it.

Advantageously, any magnetic materials adhered to the magnetic shaft may be cleaned off the shaft as it is retracted, allowing more magnetic materials to be adhered to the magnetic shaft as it is extended back into the material flow in the next cycle. Furthermore, the cylinder wiping seal or independent wiping means are effective and reliable methods of removing adhered magnetic material from the magnetic shaft at the point the shaft retracts into the cylinder or within a housing and allows the magnetic materials to be collected outside the material flow area for disposal or reuse. Preferably, the method of separating magnetic materials from non-magnetic materials in a material flow further comprises the step of:

rotating the magnetic shaft by an angular increment one or more times in each cycle.

Advantageously, the bulk of material from the material flow that may otherwise build up on a top portion of the magnetic shaft when the magnetic shaft is exposed to the material flow may be removed by rotation. Furthermore, rotation ensures that the wear of the magnetic shaft caused by mechanical abrasion is evenly distributed around the magnetic shaft. If the magnetic shaft is not evenly worn, it will need to be replaced sooner, which is both inconvenient and costly. Furthermore, uneven or localised wear may prevent effective wiping and thus cleaning by the cylinder wiping seal or independent wiping seal may cause it premature damage.

Preferably, the method of separating magnetic materials from non-magnetic materials in a material flow further comprises the step of:

rotating the magnetic shaft by an angular increment at the commencement of the retraction stroke of each cycle.

The advantage of rotating the magnetic shaft by an angular increment at the commencement of the retraction stroke is that material from the material flow that has built up on the top portion of the magnetic shaft while the magnetic shaft has been exposed to the material flow may be shifted off the magnetic shaft to rejoin the material flow.

Preferably, the method of separating magnetic materials from non-magnetic materials in a material flow further comprises the step of:

rotating the magnetic shaft by an angular increment at the commencement of the extension stroke of each cycle.

The advantage of rotating the magnetic shaft by an angular increment at the commencement of the extension stroke is that magnetics remaining on the top of the non magnetic end portion of the magnetic shaft are dislodged before re-entry of the shaft into the material flow.

Other aspects of the invention are also disclosed and include the minimization of waste by utilizing the exhaust air or fluid from retraction strokes to prevent product escaping on the top surface of the retracting shaft or by 'bounce' and to utilize air or fluid from extension strokes to prevent magnetic fragments which may remain on the non magnetic distal end of the shaft from re-entering the product when the shaft re-enters the material flow area.

BRIEF DESCRIPTION OF THE DRAWINGS

Preferred embodiments of the present invention will now be described, by way of examples only, with reference to the accompanying drawings in which.

DETAILED DESCRIPTION OF SPECIFIC EMBODIMENTS

Figure 1:
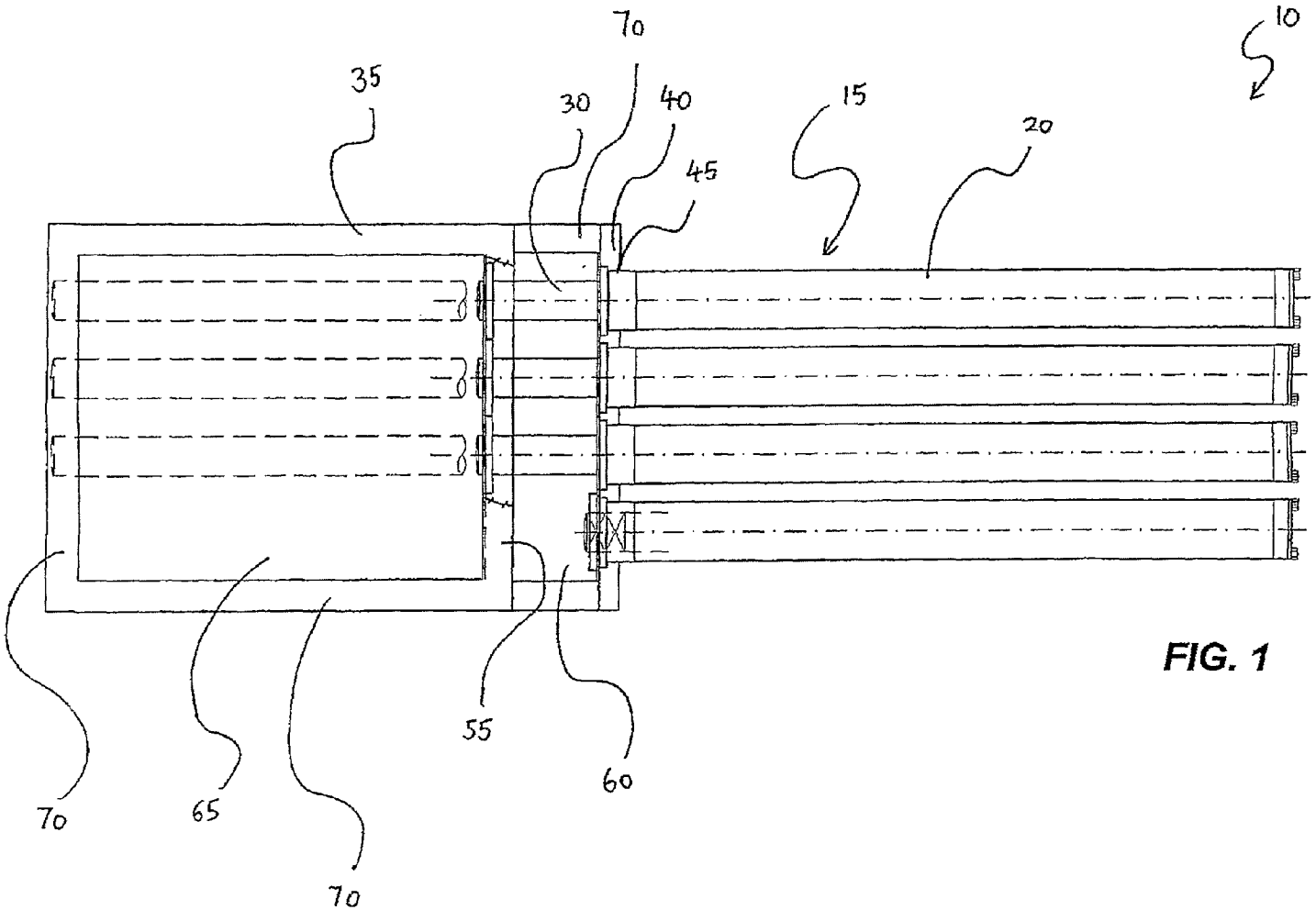
FIG. 1 is a top view of a magnetic separation apparatus in accordance with a preferred embodiment of the present invention.

Referring to the figures, magnetic separation apparatus' 10 are provided in accordance with a number of different embodiments and variations. The magnetic separation apparatus' may be used for separating magnetic materials from non-magnetic materials in a material flow. It should be noted in the following description that like or the same reference numerals in different embodiments or variations denote the same or similar features.

Figure 2:
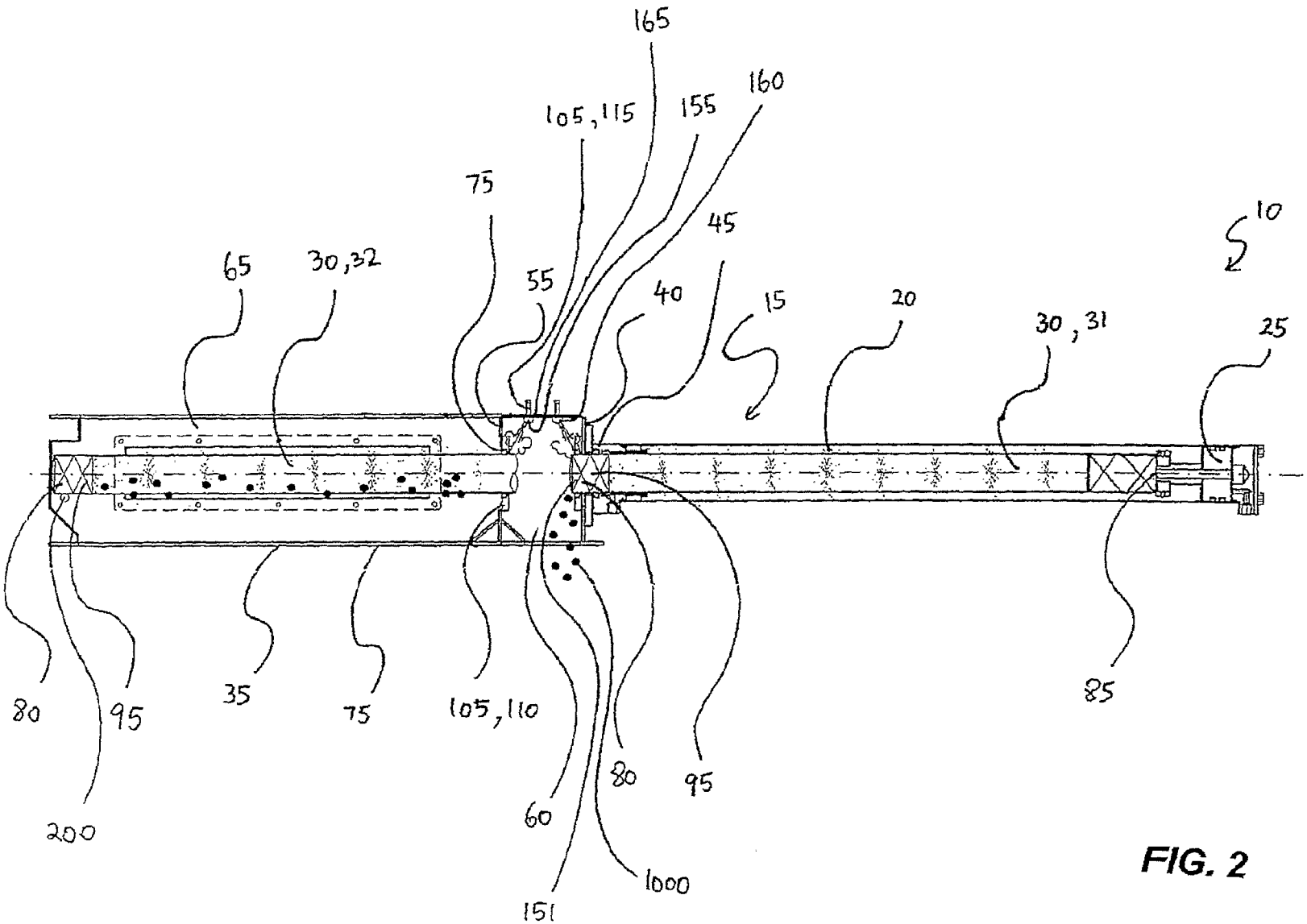
FIG. 2 is a cross-sectional side view of the magnetic separation apparatus of FIG. 1, showing a magnetic shaft in an extended and a retracted position.

Referring to FIGS. 1 to 2, the magnetic separation apparatus 10 comprises a plurality of magnetic separators 15, four of which are shown. The magnetic separators 15 are alike, comprise the same components and are arranged parallel to each other in one horizontal plane. For the sake of clarity, only one of the magnetic separators 15 will be hereinafter described in detail.

The magnetic separator 15 comprises a cylinder 20, a piston 25 slidingly mounted within the cylinder 20 (see FIGS. 2 and 3) and a magnetic shaft 30 extending axially from the piston 25. In this embodiment, the apparatus 10 is adapted to pneumatically actuate the piston 25 within the cylinder 20 between a retracted position 31 and an extended position 32. The movement of the shaft 30 from the retracted 31 to the extended position 32 is hereinafter defined as an extension stroke, and the movement of the shaft 30 from the extended to the retracted position 31 is defined as a retraction stroke.

Figure 3:
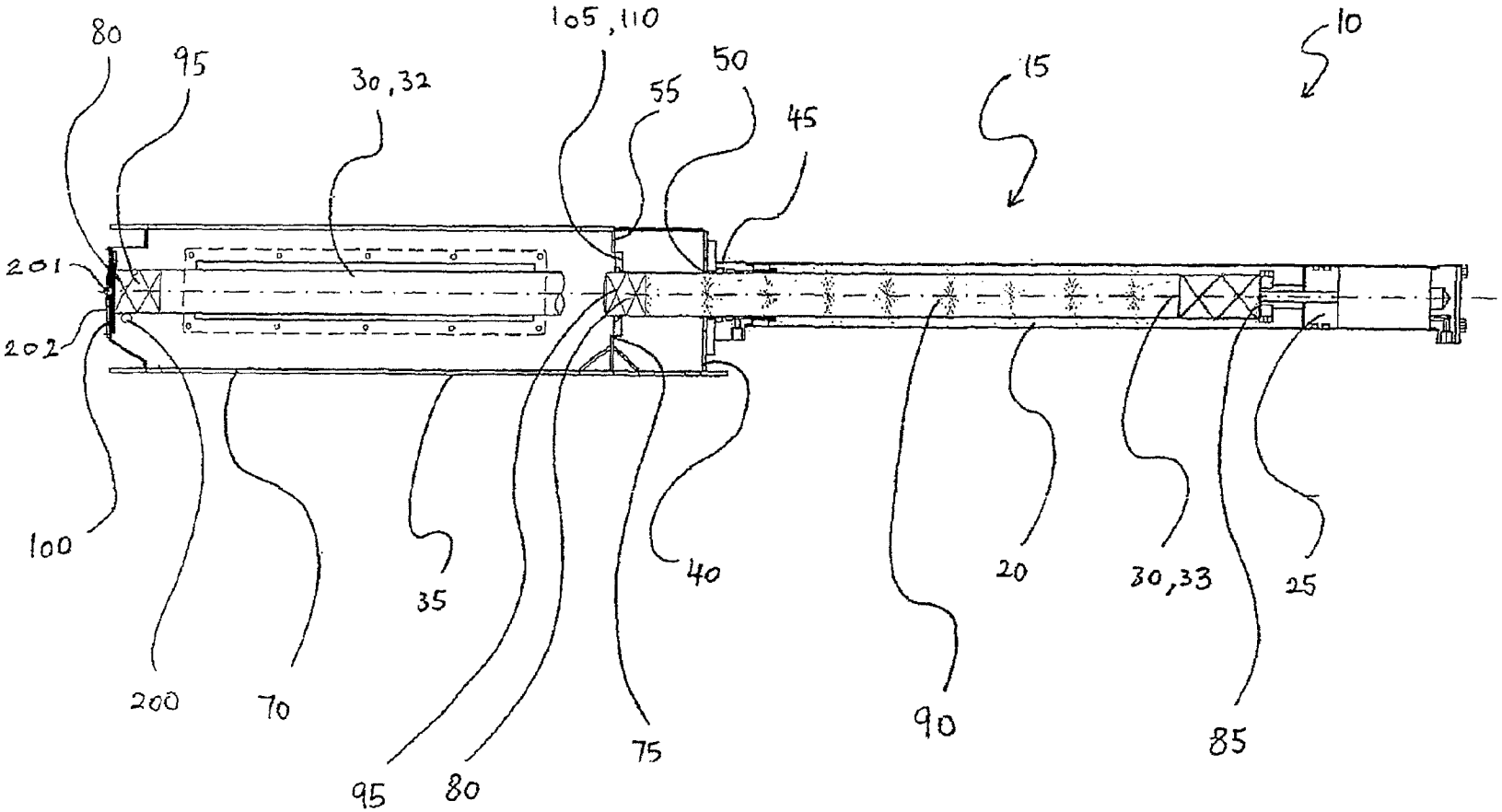
FIG. 3 is a cross-sectional side view of a variation of the magnetic separation apparatus of FIG. 1, showing a magnetic shaft in an intermediate position.

Referring specifically to FIG. 2, the shaft 30 of the magnetic separator 15 is shown in the retracted position 31 and the shaft 30 is shown in the extended position 32. In the retracted position 31, the shaft 30 is substantially located within the cylinder 20, and in the extended position 32, a majority of the shaft 30 is located externally to the cylinder 20. Referring specifically to FIG. 3, the shaft 30 is shown in an intermediate position 33 between the retracted and the extended position 32. It should be appreciated that the piston 25 may be actuated by other means. In one embodiment, the piston 25 is actuated by hydraulic means. In another embodiment, the piston 25 is actuated by mechanical or other powered drive mechanism means. The magnetic separation apparatus further comprises a housing 35 having a first wall 40. A first end 45 of the cylinder 20 is mounted to the first wall 40 such that the cylinder 20 extends from an outer surface of the first wall 40. The first wall 40 has a housing aperture 50 for the shaft 30 of each magnetic separator 15. All of the housing apertures 50 are equivalent, and thus, for the sake of clarity, only one housing aperture 50 will be described.

The housing aperture 50 is relatively larger in diameter than the shaft 30 and is aligned with the shaft 30, such that when the magnetic separator 15 is in operation, the shaft 30 moves through the housing aperture 50 as the shaft 30 is moved between the extended position 32 and the retracted position 31.

The housing 35 also has a separation wall 55 defining a magnetic materials collection section 60 that is separate to a material flow section 65. The magnetic materials collection section 60 is located intermediate the first wall 40 and the separation wall 55. In this embodiment, the housing 35 also has side walls 70 that enclose the material flow section 65 and the magnetic materials collection section 60 about the sides. The separation wall 55 has a separation wall aperture 75 for the shaft 30 of each magnetic separator 15. All of the separation wall apertures 75 are equivalent, and thus, for the sake of clarity, only one separation aperture 75 will be described.

The separation wall aperture 75 is relatively larger in diameter than the shaft 30 and is aligned with the shaft 30, such that when the magnetic separator 15 is in operation, the shaft 30 moves through the housing aperture 50 and subsequently through the separation wall aperture 75 as the shaft 30 is moved between the extended position 32 and the retracted position 31. Thus, the shaft 30 first enters the magnetic materials collection section 60 through the housing aperture 50 and subsequently enters the material flow section 65 through the separation wall aperture 75. In this embodiment, except for the separation wall apertures 75, the separation wall 55 substantially isolates the magnetic materials collection section 60 from the material flow section 65.

A distal end 80 and a proximal end 85 of the shaft 30 are defined as being distal and proximal, respectively, to the first wall 40 when the shaft 30 is in the extended position 32. The proximal end 85 of the shaft 30 is releasably attached to the piston 25. The shaft 30 comprises a magnetic zone 90 extending along the majority of the shaft 30. The shaft 30 further comprises a relatively small non-magnetic zone 95 located at the distal end 80. In FIGS. 2 and 3, schematic magnetic fields of the magnetic zone 90 are represented by curved dotted lines, and the non-magnetic zone 95 is represented by a crossed pattern.

Referring to FIGS. 2, 3 and 5 to 10, the magnetic separation apparatus 10 further comprises a cleaning means 105 for the shaft 30 of each magnetic separator 15 that is adapted to clean an outer surface of the shaft 30 as it is moved from the extended position 32 to the retracted position 31.

In the embodiment of FIG. 2, the cleaning means 105 comprises a wiping means 110 and a pressurised gas delivery means 115 while the variation of this embodiment shown in FIG. 3 does not include a pressurised gas delivery means 115.

Referring specifically to FIGS. 5 to 10, the wiping means 110 has a wiping lip 120 defining a wiping aperture (see FIG. 5) and a wiper supporting ring 125 (see FIG. 6) disposed around the wiping lip 120 when assembled. In this embodiment, the wiping lip 120 and wiper supporting ring 125 are modularly assembled to form the wiping means 110. In another embodiment, the wiping lip 120 and wiper supporting ring 125 are integral. The wiping lip 120 has an engagement portion 130 defining an outer diameter of the wiping lip 120 and a first and second inner rim 135, 136 of smaller diameter than the engagement portion 130 that protrudes to one side of the engagement portion 130. The first inner rim 135 is thicker and sturdier than the second inner rim 136. An inner surface of the wiper supporting ring 125 has a circular notch 140 and a first and second circular rim 145, 150. The circular notch 140 is generally congruent with the engagement portion 130 and the first and second circular rims 145, 150 are generally congruent with the first and second inner rims 135, 136, respectively, such that when the wiping means 110 is assembled, the wiping lip 120 mates tightly and securely within the wiper supporting ring 125. In this embodiment, the wiping ring 120 is made of a wear-resistant thermosetting plastic.

The shaft 30 is adapted to be located through the wiping aperture. The diameter of the shaft 30 and the wiping aperture are substantially congruent such that the fit of the shaft 30 within the wiping aperture is tight (see FIGS. 7 and 8). The wiping means 110 is disposed around the shaft 30 within the magnetic materials separation section 60 and an outer diameter of the wiper supporting ring 125 is relatively larger than both the diameter of the housing aperture 50 and the separation wall aperture 75. Thus, when the shaft 30 is in the retracted position 31 (see FIG. 2), the wiping means 110 is disposed around the distal end 80. As the shaft 30 is moved towards the extended position 32, the wiping means 110 remains fixed at the same position on the shaft 30 and travels with the shaft 30, until it reaches the intermediate position 33 (see FIG. 3), at which point the wiper supporting ring 125 abuts the region surrounding the separation wall aperture 75 and is substantially stopped from moving past the separation wall 55.

As the shaft 30 is moved further towards the extended position 32, the shaft 30 slides frictionally through the wiping aperture until it reaches the extended position 32 (see FIG. 2). At this point, the wiping means 110 is located closer to the proximal end 85. As the shaft 30 is then moved back towards the retracted position 31, the wiping means 110 remains fixed at the same position on the shaft 30 and travels with the shaft 30, until it reaches a second intermediate position (not shown), at which point the wiper supporting ring 125 abuts the region surrounding the housing wall aperture 50 and is substantially stopped from moving past the housing wall 40. As the shaft 30 is moved further towards the retracted position 31, the shaft 30 slides frictionally through the wiping aperture until it reaches the retracted position 31. The wiping means 110 is orientated such that the larger first inner rim 135 is located nearer the separation wall 55 than the second inner rim 136. It should be noted that in the retracted position 31, an end portion 95 of the shaft 30 at the distal end 80 does not slide through the wiping aperture and remains located within the magnetic materials collection section 60. Thus, the end portion 95 is not cleaned by the wiping means 110.

In this embodiment, when the wiper supporting ring 125 abuts either the separation wall 55 or the housing wall 40, it substantially seals the magnetic material collection section 60 from the material flow section 65 or the magnetic material collection section 60 from the exterior of the housing 35, respectively. In another embodiment, the wiper supporting ring 125 is adapted to be magnetically attracted to the housing wall 40.

Referring to FIG. 2, the pressurised gas delivery means 115 has a first and a second output nozzle 155, 160 located on an inner surface of a top wall 165 of the magnetic materials collection section 60, and a gas duct for each output nozzle (not shown) for conveying pressurised gas to the respective output nozzles 155, 160. The first output nozzle 155 is directed such that the pressurised gas delivery means 115 is adapted to blow pressurised gas on a portion of the shaft 30 as it passes through the separation wall aperture 75 to the retracted position 31 and the second output nozzle 160 is directed such that the pressurised gas delivery means 115 is adapted to blow pressurised gas on a portion of the shaft 30 as it passes through the housing aperture 50 towards the extended position 32. In this embodiment, the gas ducts convey pressurised air expelled from the cylinder 20 by the piston 25 during the retraction 31 and the extension 32 strokes. In another embodiment the gas ducts only convey pressurised air expelled from the cylinder 20 by the piston 25 during the retraction 31 or extension 32 stroke. In another embodiment, the gas duct supplying the first output nozzle 155 conveys pressurised air from the cylinder 20 by the piston 25 in the retraction stroke, and the gas duct supplying the second output nozzle 160 conveys pressurised air from the cylinder 20 by the piston 25 in the extension stroke. In another embodiment, the gas ducts convey pressurised gas from an external pressurised gas source.

Figure 4:
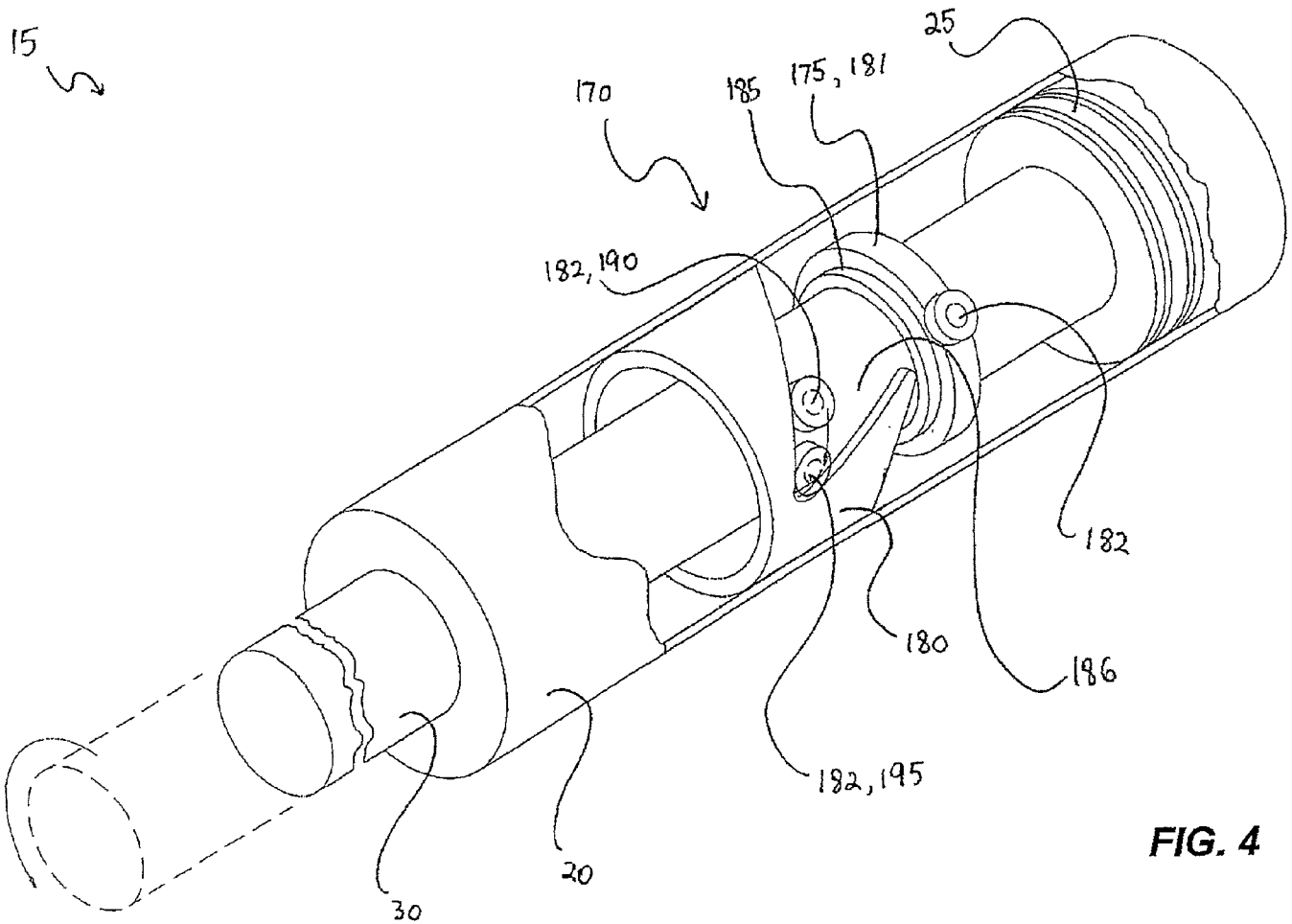
FIG. 4 is a partial cut-away detailed perspective view of a rotation mechanism of the magnetic separation apparatus of FIG. 3.
Figure 8:
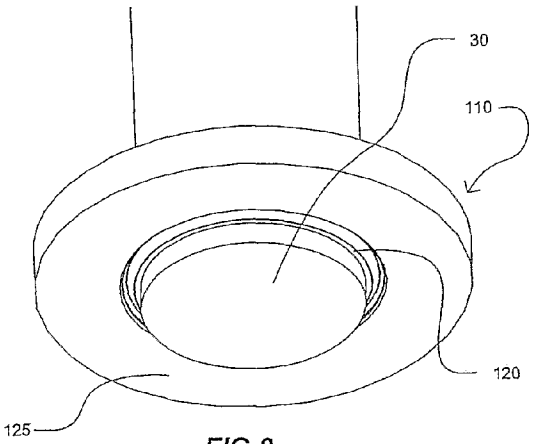
FIG. 8 is a top perspective view of the wiping means and a portion of the magnetic shaft of the magnetic separation apparatus of FIG. 3.
Figure 10:
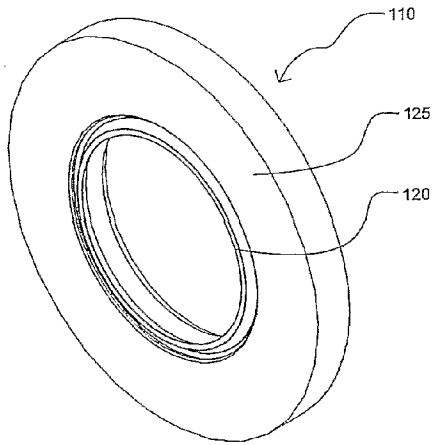
FIG. 10 is a perspective view of the wiping means of the magnetic separation apparatus of FIG. 3.
Figure 7:
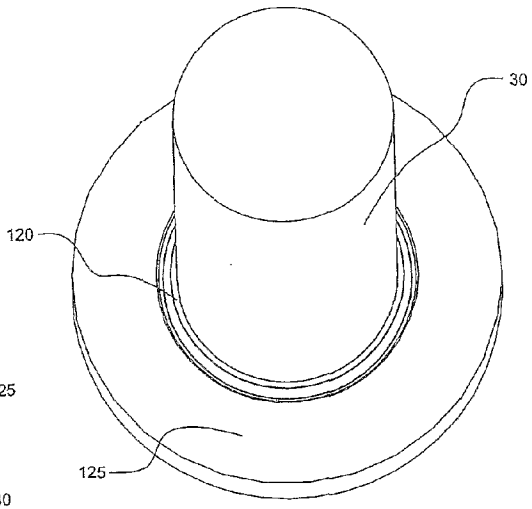
FIG. 7 is a bottom perspective view of the wiping means and a portion of a magnetic shaft of the magnetic separation apparatus of FIG. 3.
Figure 9:
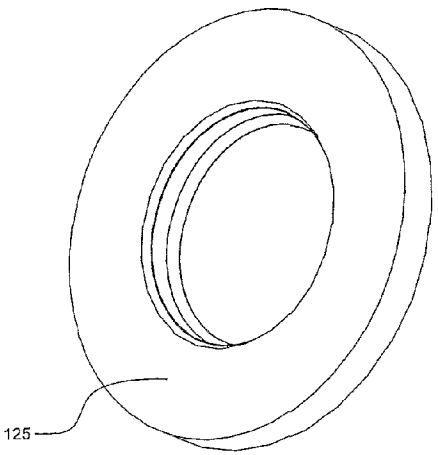
FIG. 9 is a perspective view of a wiper supporting ring of the magnetic separation apparatus of FIG. 3.
Figure 6:
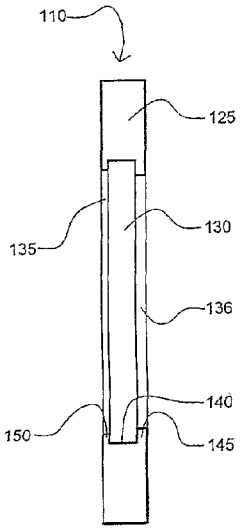
FIG. 6 is a cross-sectional side view of a wiping means of the magnetic separation apparatus of FIG. 3.
Figure 5:
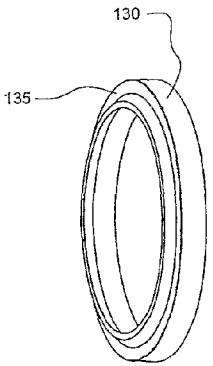
FIG. 5 is a perspective view of a wiping lip of the magnetic separation apparatus of FIG. 3.

Referring to FIG. 4, the magnetic separator 15 further comprises a rotation means 170 located within the cylinder 20 that is adapted to incrementally rotate the shaft 30 by an angular increment at the commencement of each retraction and extension stroke. The rotation means 170 is a spiral cam mechanism comprising a spiral cam engagement means 175 disposed around a portion of the outer surface of the shaft 30, and a spiral cam track 180 located within the cylinder 20.

The spiral cam engagement means 175 is adapted to be actuated between a first and a second mode. In the first mode, the spiral cam engagement means 175 is rotatable in one direction (clockwise or anti-clockwise) relative to the shaft 30. In the second mode, the spiral cam engagement means 175 is rotationally fixed relative to the shaft 30. In this embodiment, the spiral cam engagement means 175 comprises an annular ring 181 and a track engagement cam pin 182 disposed on an outer surface of the annular ring 181. The annular ring 181 is located around a sprag clutch 185 and is adapted to be normally in the first mode by a bias mechanism.

In this embodiment, the spiral cam track 180 comprises a wall disposed on a portion of an inner surface of the cylinder 20 that has an elongated triangular opening 186 orientated towards the piston 25 and located at a position along the cylinder 20 that is ahead of the spiral cam engagement means 175. As the shaft 30 is moved towards the extended position 32, the spiral cam engagement means 175 travels with the shaft 30 in the first mode until the track engagement cam pin 182 engages the spiral cam track 180 at a first position 190 near the end of the extension stroke. At this point, some of the forward/extending axial motion of the shaft 30 is converted into a rotational motion of the spiral cam engagement means 175 by virtue of the spiral cam track 180 and as the track engagement cam pin 182 moves along a diagonally transverse first side of the triangular opening 186. As it is in the first mode, the spiral cam engagement means 175 rotates relative to the shaft 30 until it is substantially stopped at an apex of the triangular opening 186 at a second position 195. The shaft 30 has reached the end of the extension stroke at this point.

As the shaft 30 commences the retraction stroke, the track engagement cam pin 182 experiences some friction as it engages a diagonally transverse second side of the triangular opening 186. This friction tends to retard the motion of the spiral cam engagement means 175 relative to the retracting shaft 30, which engages the sprag clutch 185, such that the spiral cam engagement means 175 moves into the second mode. Hence, the retraction of the shaft 30 causes the spiral cam engagement means 175 to rotate the entire shaft 30 relative to the cylinder 20 until the track engagement cam pin 182 disengages from the spiral cam track 180. The track engagement cam pin 182 returns to position 182 upon disengagement and the shaft continues the retraction stroke. The track engagement cam pin 182 will reengage the spiral cam track 180 at the position 190 near the end of the subsequent extension strokes and thus, the shaft 30 will be rotated by an angular increment at the commencement of each retraction stroke. In this embodiment, each angular increment lies between 43° and 53° and/or is indivisible by 360° such that a compound error of position occurs to ensure the section exposed to material flow is different with each revolution of the magnetic or separator shaft 30.

In another embodiment, instead of a sprag clutch, a clutch bearing is used. In another embodiment, instead of a track engagement cam pin, a cam roller, cam bearing or robust free bearing is used. In another embodiment, a similar but opposingly orientated spiral cam track is provided at a suitable position within the cylinder 20 such that rotation by an angular increment is achieved at the commencement of each extension stroke. In another embodiment, the shaft 30 is adapted to be rotated at any point during either the extension or retraction stroke. In another embodiment, the shaft 30 is adapted to be rotated at a plurality of points during either or both the extension or retraction stroke. In another embodiment, the shaft 30 is adapted to be continuously rotated. The rotation means 170 is preferably configured to provide an abrupt rotation to better release and remove material from the top surface of the magnetic shaft 30.

It should be noted that the incremental rotation at the start of the retraction stroke can be repeated by means of the cylinder valving and appropriate control action (e.g. by a PLC) to provide a mild jack hammer type movement to the magnetic shaft 30. Such movement advantageously assists in dislodging certain types of clinging non-magnetic materials if they have adhered to the top and side of the magnetic shaft 30.

This form of agitation can be useful in cases where the first and second output nozzles 155, 160 cannot be used, such as in open applications without a housing to ensure that the shaken non-magnetic materials are relatively contained or where the gas to be discharged through the nozzles might contaminate the material flow (e.g. if the material is a sensitive product).

Referring to FIG. 2, the magnetic separation apparatus 10 further comprises a shaft support means 200 for supporting the weight of the shafts 30 of the magnetic separators 15 when in the extended position 32. In this embodiment, the shaft support means 200 takes the form of a transverse support rod that supports the distal end 80 of each shaft 30 in use. The distal ends 80 of the shafts 30 are rounded, such that as each shaft 30 reaches the extended position 32, it contacts and rides up the transverse support rod 200 and is supported by the rod 200 until the shaft 30 is retracted.

FIG. 3 shows a variation on this embodiment where a disc 100 is adapted to remain fitted to the distal end 80 of each shaft 30 while the magnetic separation apparatus 10 is in operation. The shaft support means takes the form of a tapered pin and corresponding pin aperture arrangement 201 for each shaft 30. The tapered pin extends from a distal surface of the disc 100 and is aligned with the corresponding pin aperture located in a second wall 202 of the housing 35. The second wall 202 opposes the first wall 40 at a distance such that the disc 100 of each shaft 30 flushly abuts an inner surface of the second wall 202 when the shaft 30 is in the extended position. Thus, when each shaft 30 is approaches the end of the extension stroke, the tapered pin engages the pin aperture and the shaft 30 is mechanically supported by virtue of the engagement.

The magnetic separators 15 are adapted to be retracted one at a time. In another embodiment, the magnetic separators 15 are adapted to be retracted two at a time. In another embodiment, the magnetic separators 15 are adapted to be retracted more than two at a time.

The magnetic separation apparatus 10 is adapted to be in operation when a material flow passes through the material flow section 65, such that a significant portion of the outer surface of the shaft 30 of each magnetic separator 15 is exposed to the material flow in the extended position 32. Magnetic material 1000 amongst the material in the material flow is attracted to the magnetic shafts 30 and becomes magnetically adhered to the shafts 30.

As each shaft 30 is retracted, the shaft 30 and the adhered magnetic material move through the relatively large separation aperture 75 without impedance and this allows the adhered magnetic material to pass into the magnetic materials collection section 60. Note that the separation apertures 75 are sufficiently large such that this may occur in most instances.

When the shaft 30 is subsequently frictionally slid through the wiping aperture passing the thicker inner rim 135 of the wiping lip 120, the magnetic material 1000 adhered to the outer surface of the shaft 30 is substantially wiped off by the wiping lip 120, causing the magnetic material 1000 to fall into the magnetic materials collection section 60. The wiper supporting ring 125 rigidly supports the wiping lip 120 in wiping the shaft 30 as the shaft 30 is being retracted. The cleaned shaft 30 can then be extended once again and exposed to the material flow to remove further magnetic material present therein.

It should be noted that in this embodiment, while the sliding of each shaft 30 through the wiping aperture during the retraction stroke causes substantial removal of the adhered magnetic materials from the shaft 30, the sliding of the shaft 30 through the wiping aperture during the extension stroke substantially does not remove adhered magnetic materials from the shaft 30.

It is advantageous that the piston 25 and hence the shaft 30 attached thereto is actuated by pneumatic means, as pneumatic actuation is an effective method of moving a shaft to and fro between two fixed positions.

Furthermore, it is advantageous that the proximal end 85 of each shaft 30 is releasably attached to the piston 25, as this allows the shaft 30 to be readily detached from the magnetic separator 15, which may be useful for cleaning or servicing.

The provision of the housing 35 ensures that the moving components of the magnetic separation apparatus 10 are substantially contained in an enclosed area when in use. This is desirable to protect the moving components, prevent further contamination of the material, prevent operator injury and reduce material waste. The separation wall 55 physically separates the magnetic materials collection section 60 and the material flow section 65, allowing the cleaned material and the removed magnetic material to be separately collected. This reduces the amount of recontamination of the material with removed magnetic materials and reduces the amount of material wastage, which may otherwise arise by the material falling into the magnetic materials collection section 60. The actuation of the shafts 30 of the magnetic separators 15 through the separation wall 55 also allows the magnetic separation apparatus 10 to be relatively short compared to means of actuating a magnetic bar or bars by a single pneumatic or hydraulic cylinder when the cylinder shaft is not magnetic and the magnetic bar(s) is attached thereto. This may be useful where the physical area is limited in height and/or space and the inherent difficulty of synchronising two or more pneumatic cylinder actuators is to be overcome.

The disc 100 has a diameter that is larger than the separation wall aperture 75D such that when the magnetic separation apparatus 10D is no longer in use (or certain parts are in service) and the shaft 30D is in the retracted position, the disc 100D extends across and substantially seals the separation wall aperture 75D. This prevents contaminants or particles from entering the magnetic materials collection section 60 and consequently from entering the cylinder 20 and potentially damaging or soiling the apparatus components. This also prevents dust and dirt from escaping from within the mechanism.

The wiping means 110 is an effective and reliable method of removing magnetic material from the shaft 30, substantially without damage to the shaft 30, and allows the magnetic materials to be collected for disposal or reuse.

It is advantageous to use the wiping means 110 of this embodiment as the wiping lip 120 provides effective wiping and the wiper supporting ring 125 provides strength and rigidity and further acts as a flange to substantially constrain the motion of the wiping means 110 to within the magnetic materials collection section 60. Moreover, thermosetting plastic is an extremely wear resistant material that is hard and produces little friction, and is thus suitable to be used for forming the wiping lip 120.

The 'movable' wiping means 110 is advantageous, particularly in preference to a fixed wiping means. This ameliorates the problem of the misalignment of the wiping aperture, which may arise if the wiping means is fixed to the first wall 40 especially as the wiper aperture needs to relatively tightly fit the shaft 30 for the shaft 30 to be effectively cleaned.

Furthermore, the provision of individual wiping means 110 for each shaft 30 allows each shaft 30 to be cleaned individually. As it requires less force to actuate a single shaft through a tight aperture than to actuate an entire rack of bars through a number of tight apertures, individual cleaning requires less force than cleaning the shafts simultaneously, and thus the size of each piston 25 may be correspondingly small, which saves space. This also allows the magnetic material separation to be continuously provided as there will always be at most one shaft 30 in the retracted position at a given time and that for only a few seconds to allow cleaning of the magnetic shaft 30.

It is also advantageous that as the shaft 30 undergoes the extension stroke, the wiper supporting ring 125 seals the magnetic material collection section 60 from the material flow section 65, as this effectively prevents material from the material flow from entering the magnetic material collection section 60 (and thus reduces the amount of wastage) and also prevents magnetic material from reentering the material flow section 65 and recontaminating the material yield.

Each wiping lip 120 also substantially wipes the respective shaft 30 in one direction, that is, during the retraction stroke. This is referred to as unidirectional wiping. Bi-directional wiping means, that is, wiping means that substantially wipe shafts during both the retraction and extension strokes are unsuitable for frequently actuated shafts, as they have in previous art, had the tendency to cause a build up of magnetic material within the wiping aperture. Each wiping lip 120 allows magnetic material still adhered to the respective shaft 30 after the retraction stroke to pass back through the wiping aperture upon the subsequent extension stroke. The magnetic material is then able to be removed during the following retraction stroke.

As the end portion 95 at the distal end 80 of each shaft 30 is not cleaned by the wiping means 110 even when the shaft 30 is fully retracted into the retracted position 31, it is advantageous that it is non-magnetic. Thus, while materials may build up on a top portion of the end portion 95, there will be substantially no magnetic materials adhered to the end portion 95, and the blowing of pressurised gas from the second output nozzle 160 onto the end portion 95 will be sufficient to substantially remove any remaining loose magnetic or other material before it returns into the material flow section 65.95

The first output nozzle 155 of the pressurised gas delivery means 115 is particularly useful if it is directed to blow pressurised gas from within the magnetic materials collection section 60 at the separation wall aperture 75. This causes material from the material flow that may otherwise enter the magnetic material collection section 60 through the separation wall aperture 75 to be substantially blown back into the material flow section 65. Some material from the material flow may tend to enter the magnetic materials collection section 60 during the retraction stroke 31 as material bounces off the shaft 30, or is built up on a top portion of the shaft 30 and enters with the shaft 30. Thus, the use of the first output nozzle 155 reduces potential material wastage. The extension and retraction strokes are efficient sources of pressurised air, as no additional pressurised gas source is required. This reduces operational costs. However, if the apparatus 10 is actuated hydraulically or if the pressurised air expelled from the cylinder by the piston during the retraction or extension stroke is not adequately pressured, an external pressurised gas source may be alternatively used.

Another advantage of the magnetic separation apparatus 10, is that material from the material flow that may otherwise build up on the top portion of the shaft 30 of each magnetic separator 15 when the shaft 30 is exposed to the material flow may be removed by the abrupt incremental rotation carried out by the rotational means 170 at the commencement of each retraction stroke. The non-magnetic material will then fall back into the material flow, while the magnetic material adhered to the shaft 30 will remain magnetically adhered. This reduces potential material wastage.

Furthermore, and again with reference to FIG. 4, rotation ensures that the wear of each shaft 30 caused by the mechanical abrasion of the material in the material flow is evenly distributed around the shaft 30. Excessive wear of a shaft will usually result in breakage or the discharge of magnetic wear particles into the material stream. If the shafts 30 are not evenly worn, and only one portion of the outer surface of each shaft 30 is exposed to the material flow in operation, excessive wear will occur only on the exposed portion and the shaft 30 will need to be replaced sooner, which is both inconvenient and costly. Furthermore, uneven or localised wear may prevent effective cleaning by the wiping means 110 and excessive abrasion on at a particular portion of the shaft 30 may reduce the magnetism of the shaft 30 due to oxidisation or corrosion. Thus, incremental rotation increases the lifetime of the shafts 30 and maintains their integrity of performance during their lifetimes.

If a second spiral cam track is provided and rotation by an angular increment at the commencement of each extension stroke is adapted to occur, magnetic material located on the top portion of the end portion 95 of each shaft 30 may be shifted and deposited into the respective magnetic material collection section 60. This may be used in addition to or instead of the second output nozzle 160 to perform a similar function.

The rotation means 170 of each magnetic separator 15 taking the form of the spiral cam mechanism 170 redirects the motion of the shaft 30 and converts the linear motion of the shaft 30 as provided by the pneumatic actuation into rotation by an angular increment. Thus, a motor is not required for rotating of the shaft 30, reducing manufacturing, operational and maintenance costs.

The sprag clutch is an effective and reliable method of allowing the spiral cam engagement means 175 to rotate in one direction in the first mode. Cam pins, cam rollers, cam bearings and robust free bearings are also effective and reliable methods of engaging the spiral cam engagement means 175 with the spiral cam track 180.

It is advantageous that the shaft support means 200 taking the form of a transverse support rod is provided, as when each shaft 30 is in the extended position and maximally exposed to the material flow, the weight of the material falling on the shaft 30 may be quite substantial. Since the shaft 30 can be relatively long, the combined weight of the shaft 30 and the falling material may impose a relatively large moment on the shaft 30. The shaft support means 200 substantially prevents the shaft 30 from bending by supporting the combined weight at the distal end 80.

The magnetic separation apparatus 10 removes a large amount of the magnetic materials from the material flow as it comprises the plurality of magnetic separators 15. Moreover, providing the horizontal array of magnetic separators 15 allows the rate of material processed to be relatively large.

Figure 11:
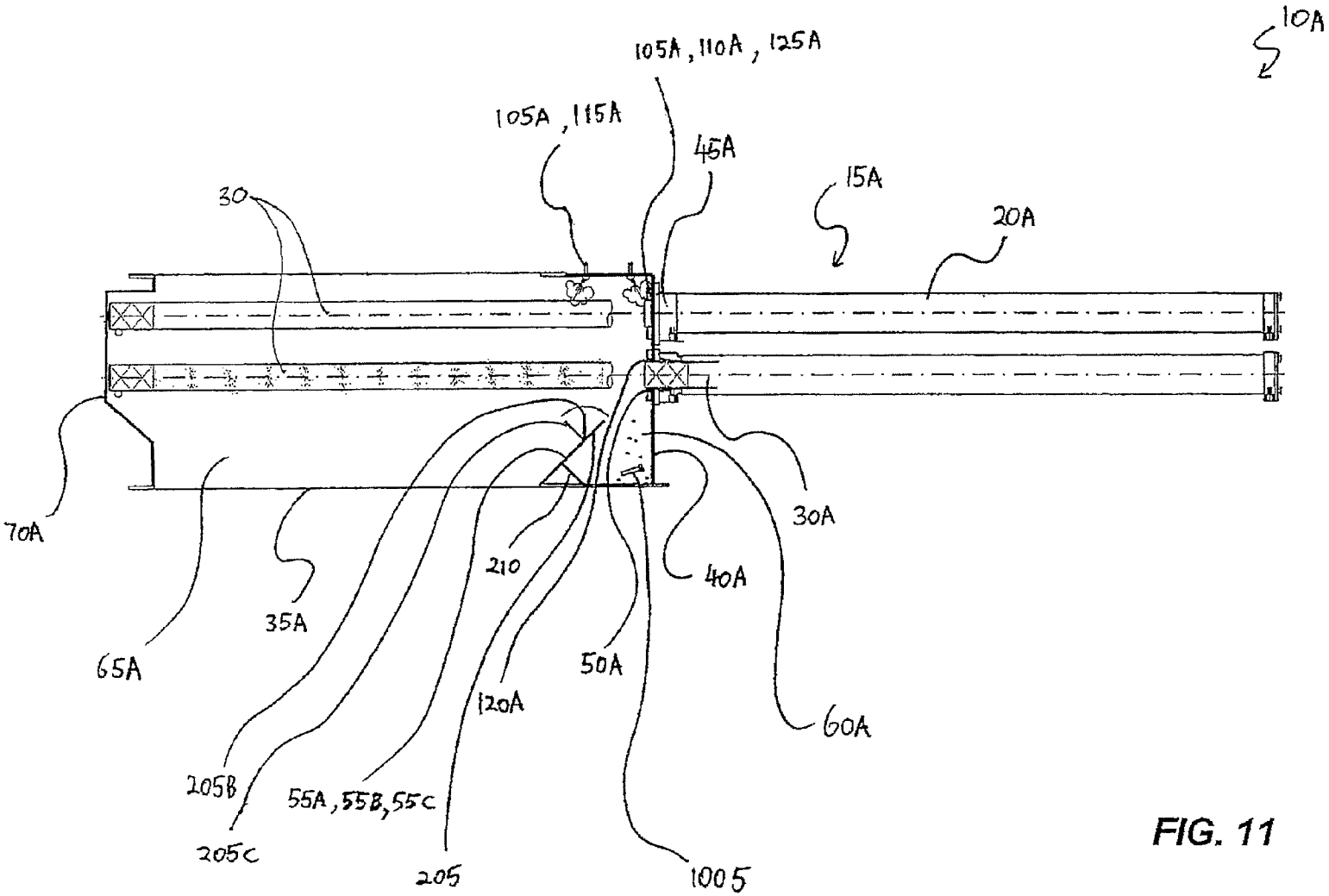
FIG. 11 is a cross-sectional side view of a magnetic separation apparatus in accordance with another preferred embodiment of the present invention having a low separation wall.

Referring to FIG. 11, the magnetic separation apparatus 10A is shown, comprising a plurality of magnetic separators 15A, two of which are shown. The magnetic separators 15A are similar to the magnetic separators 15 and operate in a similar fashion. The magnetic separators 15A are alike, comprise the same components and are arranged parallel to each other in two or more horizontal planes. In each successive horizontal plane the magnetic shafts 30 are staggered in relation to those in the plane above or below. For the sake of clarity, only one of the magnetic separators 15A will be hereinafter described in detail.

The magnetic separator 15A comprises a cylinder 20A, a piston (not shown) slidingly mounted within the cylinder 20A and a magnetic shaft 30A (partially shown) extending axially from the piston.

The magnetic separation apparatus 10A further comprises a housing 35A having a first wall 40A. A first end 45A of the cylinder 20A is mounted to the first wall 40A such that the cylinder 20A extends from an outer surface of the first wall 40A. The first wall 40A has a housing aperture 50A for the shaft 30A of each magnetic separator 15A. All of the housing apertures 50A are equivalent, and thus, for the sake of clarity, only one housing aperture 50A will be described.

The housing aperture 50A is relatively larger in diameter than the shaft 30A and is aligned with the shaft 30A.

The magnetic separation apparatus 10A further comprises a cleaning means 105A for the shaft 30A of each magnetic separator 15A that is adapted to clean an outer surface of the shaft 30A as it is moved from the extended position to the retracted position. All of the cleaning means 105A are equivalent, and thus, for the sake of clarity, only one cleaning means 105A will be described.

The cleaning means 105A comprises a wiping means 110A and a pressurised gas delivery means 115A.

The wiping means 110A has a wiping lip 120A defining a wiping aperture and a wiper supporting ring 125A disposed around the wiping lip 120A when assembled. In this embodiment, the wiping lip 120A and wiper supporting ring 125A are modularly assembled to form the wiping means 110A. In this embodiment, the wiper supporting ring 125A is fixedly mounted to the first wall 40A at the region surrounding the housing aperture 50A such that the wiping aperture is aligned with the shaft 30A. In another embodiment the wiper supporting ring is adapted to be magnetically attracted to the first wall 40A. In another embodiment, the wiping lip and wiper supporting ring are integral. When the magnetic separator 15A is in operation, the shaft 30A frictionally slides through the wiping aperture 50 as the shaft 30 is moved between the extended position 32 and the retracted position 31.

The housing 35A also has a separation wall 55A defining a magnetic materials collection section 60A that is separate to a material flow section 65A. The magnetic materials collection section 60A is located intermediate the first wall 40A and the separation wall 55A. In this embodiment, the housing 35A also has side walls 70A that enclose the material flow section 65A and the magnetic materials collection section 60A about the sides. The separation wall 60A is relatively low such that a top edge of the separation wall 55A is located below the housing apertures 50A and path of the magnetic shafts. Thus, in operation, the shaft 30 moves between the extended and retracted positions unimpeded and above the separation wall 55A.

In this embodiment, a top portion 205 of the separation wall 55A is disposed at an angle leaning towards the first wall 40A. In another embodiment, a top portion 205B of a separation wall 55B is orientated parallel to the first wall 40A. In another embodiment, a top portion 205C of a separation wall 55C is orientated at an angle leaning away from the first wall 40A. In this embodiment, the separation wall 55A is supported at a base portion by a separation wall support brace 210.

The provision of the relatively short separation wall 55A provides an open-chamber design, in which the magnetic materials collection section 60A and the material flow section 65A are separated within the housing 35A, but are not completely isolated from each other. This design has an advantage over a magnetic separation apparatus that completely isolates the sections 60A, 65A, if, in addition to containing fine magnetic material, the material flow contains larger tramp iron and particles 1005. Large pieces of magnetic material 1005 adhered to each shaft 30A may not be able to pass unhindered through separation wall apertures and may instead be pushed back into the material flow during retraction. As the relatively short separation wall 55A does not interfere with the extension and retraction of the shafts 30A, the problem is alleviated in such situations by use of the magnetic separation apparatus 10A. However, the separation wall 55A still ensures that the majority of the falling magnetic materials 1005 are directed into the magnetic materials collection section 60A without falling or bouncing back into the material flow section 65A by functioning as a shield.

In this embodiment, the provision of moveable wiping means is no longer feasible. Moreover, larger particles of magnetic materials are more difficult to remove from the magnetic shafts 30, and thus the wiping means 110A provided are more securely anchored for effective wiping.

The advantage of having the top portion 205 of the separation wall 55A disposed at an angle leaning towards the first wall 40A is to improve the function of the seperation wall 55A as a shield preventing the falling magnetic materials 1005 from bouncing back into the material flow section 65A. It also provides a sloping surface, which maintains the material flow within and redirects any stray material back into the material flow section 65A.

Providing the separation wall 55B, having the top portion 205B orientated parallel to the first wall 40A, offers similar advantages to the separation wall 55A, but has a smaller opening.

Providing the separation wall 55C, having the top portion 205C being disposed at an angle leaning away from the first wall 40A, offers similar advantages to the separation walls 55A, 55B, but provides a further increased opening size through which the magnetic materials 1005 may fall. Furthermore, any stray magnetic materials 1005 that fall on a sloping surface of the top portion 205C will be redirected back into the magnetic materials collection section 60A.

Figure 12:
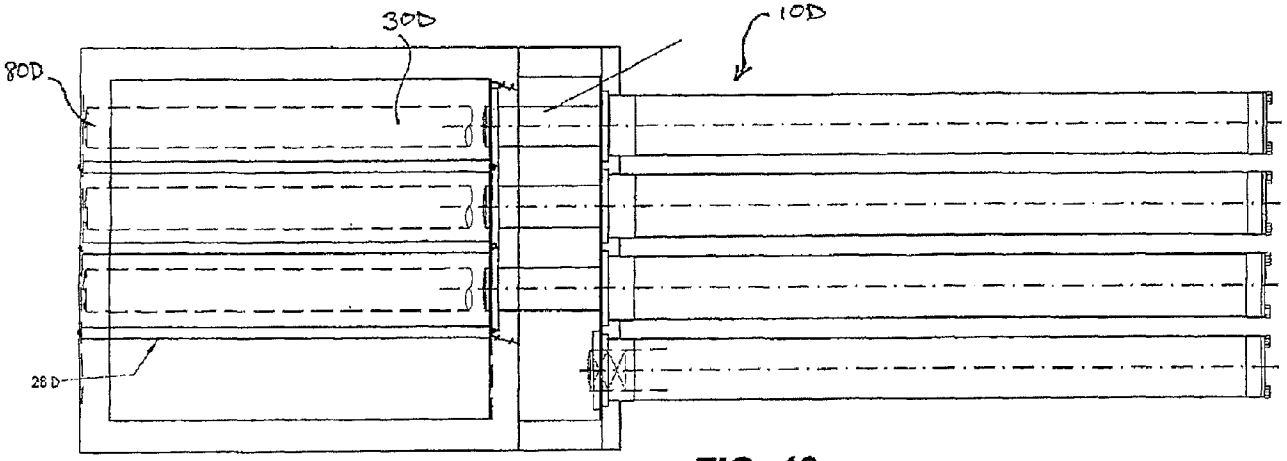
FIG. 12 is a plan view of a magnetic separation apparatus in accordance with another preferred embodiment of the present invention.
Figure 13:
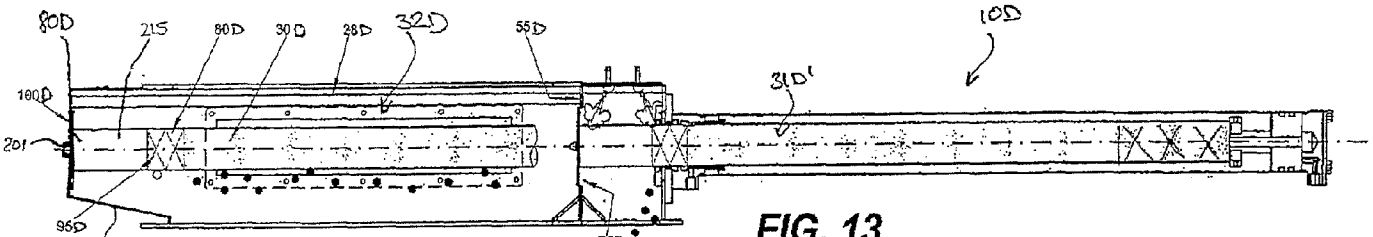
FIG. 13 is a cross-sectional side view of a magnetic separation apparatus in accordance with another preferred embodiment of the present invention.

Referring to FIGS. 12 and 13, a magnetic separation apparatus 10D having three magnetic separators 15D is provided. For the purpose of clarity only one will now be described. The magnetic separator 15D comprises a magnetic shaft 30D having a distal end 80D that is adapted to be removably fitted with a disc 100D (see FIGS. 13 & 14) and an extension 215 to the non-magnetic zone 95. The disc 100D has a diameter that is larger than the separation wall aperture 75D such that when the magnetic separation apparatus 10D is no longer in use and the shaft 30D is in the retracted position, the disc 100D extends across and substantially seals the separation wall aperture 75D.

Splitter bars 28D are also provided on either side of the or each magnetic shaft 30D for directing the material flow over or adjacent to the magnetic shafts 30D.

In this embodiment, the shaft support means 200 is replaced by a pin and aperture arrangement 201 comprising a central support pin adapted for location in a hole or socket in a far wall of a housing extension 220. In another embodiment, the central support pin can be fixed to the housing extension and the socket can be provided in the extension to the non-magnetic zone 215.

Figure 14:
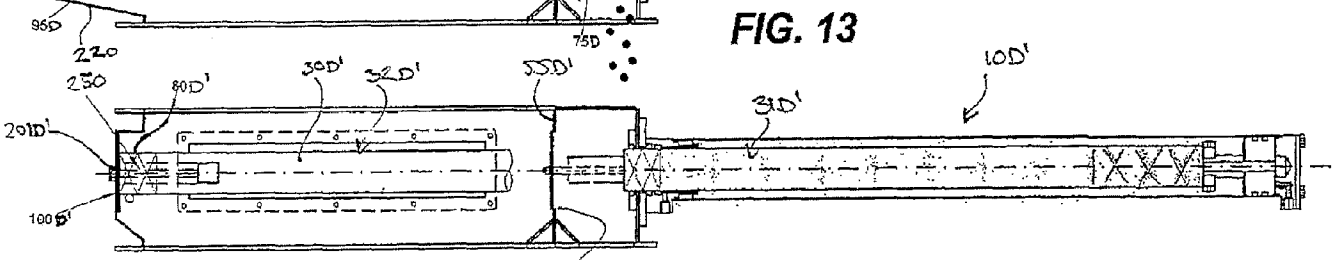
FIG. 14 is a cross-sectional side view of a magnetic separation apparatus in accordance with another preferred embodiment of the present invention.
Figure 15:
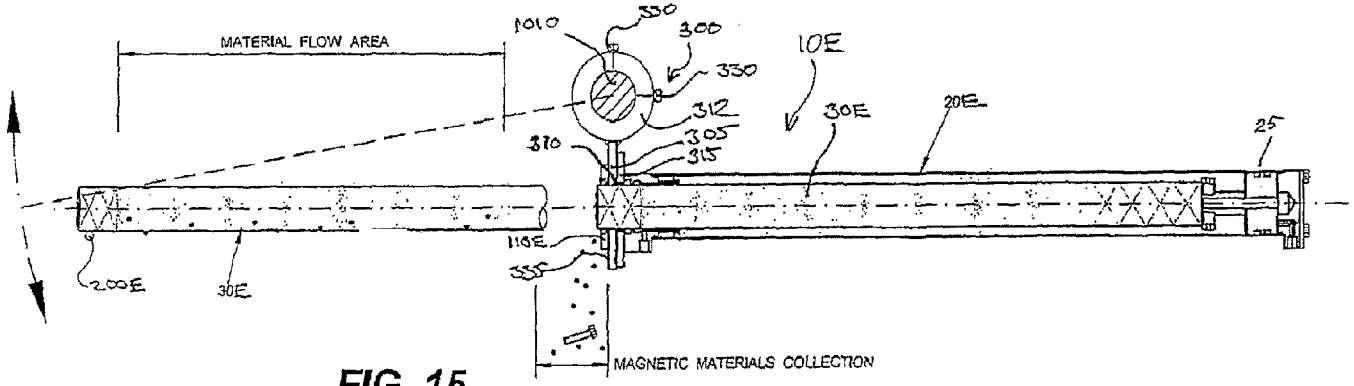
FIG. 15 is a cross-sectional side view of a magnetic separation apparatus in accordance with another preferred embodiment of the present invention.

Referring to FIG. 14, a magnetic separation apparatus 10D' having three magnetic separators 15D' is provided. For the purpose of clarity only one will now be described. The magnetic separator 15D' comprises a disc 100D' which is attached to a rod 250 that is slidable and captive within the non-magnetic distal end 80D', such that when the magnetic shaft 30D' is moved to retracted position 31D' the disc 100D' seals the separation wall aperture 75D'. The magnetic separator 15D' also comprises a pin and aperture arrangement 201D'. Referring to FIG. 15, a magnetic separation apparatus 10E is provided comprising a magnetic separator 15 that is supported by a rotatable mount 300. The rotatable mount 300 comprises a body 312 and a mount wall 305 extending therefrom and having a mount aperture 310, the mount wall 305 operating in a similar fashion to the first wall 40 of previous embodiments. The magnetic separation apparatus 10E further comprises an attachment flange 315 to which a front end of the cylinder 20E is fixed or attached, the attachment flange 315 being adapted to be fixed by screws or other attachment to the mount wall 305.

The body 312 is adapted to rotatably receive a bar 1010 therethrough such that the magnetic shaft 30E is maintained in transverse alignment with the bar 1010 (in this case perpendicular alignment). The body 312 further comprises threaded apertures therethrough and screws 330 adapted to be rotated through the threaded apertures to axially fix the rotatable mount 300 to the bar 1010.

The mount wall 305 is sufficiently robust, gusseted and anchored to surrounding structure to support the cylinder 20E and the magnetic shaft 30E when it is at rest or extended into the product stream and is engineered to allow for various adjustments. For example, the mount wall 305 can be adapted to allow the magnetic shaft 30E to be adjusted transversely so as to arrange (in the case of one magnetic separator 15E), the magnetic shaft 30E to split the product flow so it passes equally either side of the magnetic shaft 30E. If the magnetic shaft 30E is used purely as a splitter it would be replaced by a non-magnetic splitter shaft.

In the case that two or more magnetic shafts 30E are used, they can be similarly transversely adjusted and spaced to adequately cover the product stream to effect efficient magnetic separation without blockage or restriction to the material flow.

In the depicted embodiment, such transverse adjustment may be achieved by unscrewing the screws 330, moving the body 312 then screwing the screws 330 back in.

In the depicted embodiment, the rotatable mount 300 enables the shaft 30E to be declined in an open product stream to enable its use in confined areas where the magnetic separator 15E has to clear surrounding structures or in the case of two or more magnetic separators 15E to allow most non-magnetic lumps to pass or roll off the end of the two or more declined shafts 30E as encouraged to do so by the falling material rather than be bridged by material or lumps (as might otherwise happen if the two or more magnetic shafts 30E were arranged horizontally).

In all these situations, the shaft(s) 30E can be used to extract magnetic particulates from open material flows and to move such particulates to a location well clear of the material flow. The shaft(s) 30E can then discharge the magnetic particulates via the wiping means 110E fixed magnetically or otherwise against the front portion 335 of the mount wall 305 so as to be self aligning.

There are numerous applications for the magnetic separation apparatus 10E which does not incorporate a housing where a housing is not needed or possible. Examples of this may be where material is openly discharging from a belt conveyor, screw conveyor or in any way discharging from an aperture into a receptacle or simply from one point to another.

In these situations, one or more magnetic separator shafts 30E can also be extended into the material stream and be retracted to effect removal of fine, medium or large magnetic particulate contamination.

Figure 16:
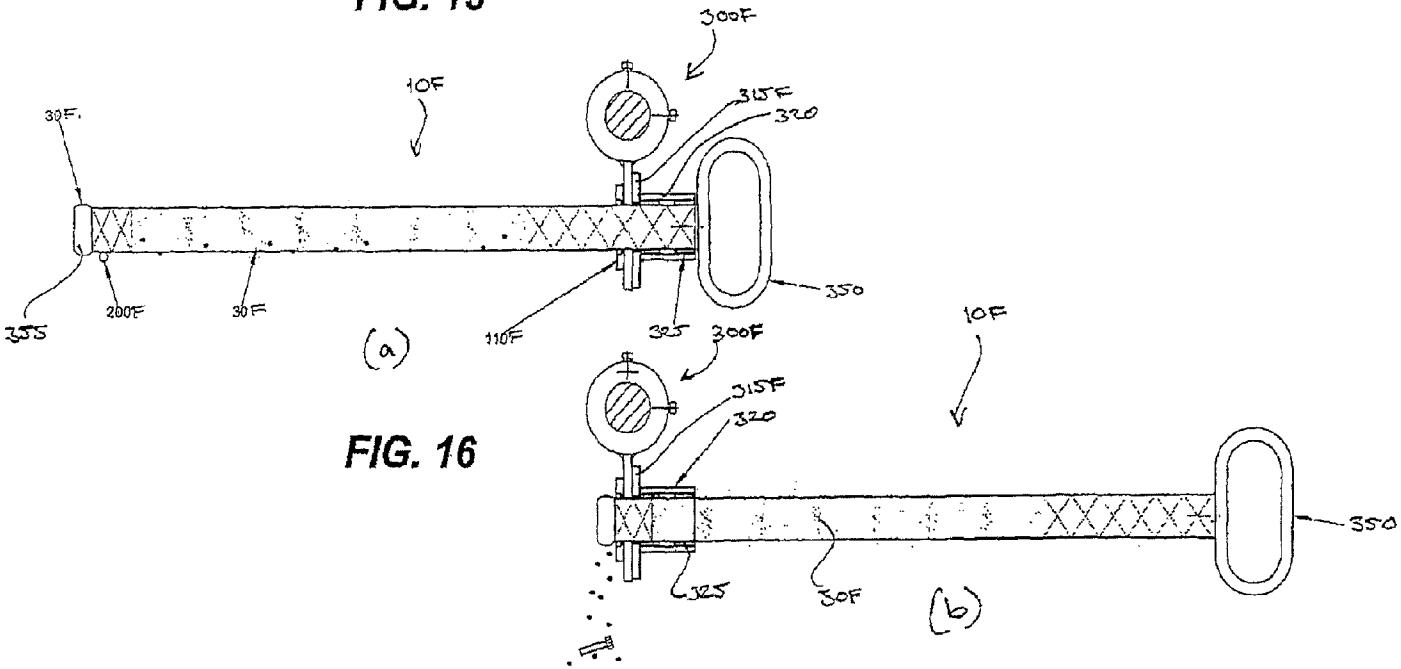
FIG. 16 is a cross-sectional side view of a manual magnetic separation apparatus in accordance with another preferred embodiment of the present invention where a magnetic shaft of the apparatus is shown in an extended position in FIG. 16(*a*) and in a retracted position in FIG. 16(*b*)

Referring to FIG. 16, a manual magnetic separation apparatus 10F is provided comprising a magnetic separator 15F that is supported by a rotatable mount 300F.

The magnetic separator 15F further comprises a flange 315F and a supporting cylinder 320 having a front end fixed (e.g. by welding) to the flange 315F. The flange 315F is attached to a mount wall 305F by screws, rivets or is fixed thereto (e.g. by welding). The supporting cylinder 320 comprises a pair of linear guide bearing arrangements 325 located within it. One linear guide bearing arrangement is located at a front end of the supporting cylinder 320 while the other is located at a rear end of the supporting cylinder 320. The magnetic shaft 30F extends through and is slidingly supported by the linear guide bearing arrangements 325 in use. In one embodiment, the linear guide bearing arrangements 325 take the form of low friction plastic bushings. In another embodiment, the linear guide bearing arrangements 325 comprise linear roller or ball type bearings. The linear guide bearing arrangements 325 act to reduce friction between the magnetic shaft 30F and the supporting cylinder 320.

The magnetic separator 15F further comprises a looped handle 350 mounted to a rear end of the magnetic shaft 30F. The magnetic shaft 30F can thus be slid axially through the supporting cylinder 320 and mount aperture 310 in to and out of the material flow area by pulling or pushing the looped handle 350.

Both the magnetic separation apparatus 10E and the manual magnetic separation apparatus 10F comprise a wiping means 110 that is fixed to a front surface of the mount wall 305 to wipe magnetic materials off the magnetic shaft 30E, 30F, respectively, as the magnetic shaft is retracted out of the material flow.

As in previous embodiments, the magnetic separation apparatus 10E and the manual magnetic separation apparatus 10F comprise a transverse support rod 200E, 200F, respectively. The transverse support rods 200E & 200F are particularly useful in supporting longer shafts 30E, 30F, respectively, when they approach their extended positions.

The manual magnetic separator 15F further comprises a rounded stop 355 that is slightly larger in diameter than the magnetic shaft 30F and that is removably attached to a front end of the magnetic shaft 30F (e.g. by a bolt) to prevent the shaft from being pulled through the wiping means 110F and mount wall aperture 310F. The stop 355 also slides over the transverse support rod 200F when the magnetic shaft 30F is being moved to the extended position to maintain the magnetic shaft 30F in the extended position until it is manually retracted.

The manual magnetic separation apparatus 10F is advantageous where space is limited, where the power assistance provided by a pneumatic or hydraulic cylinder is not required and in many other situations. Where a number of magnetic separators 15F are set up for use in a given material flow, a preferred method of using the manual magnetic separation apparatus 10F involves removing the magnetic shaft 30F of only one or two separators 15F at a time to maintain a magnetic field within the material flow at all times.

The magnetic shaft 30F may be incrementally turned by use of the spiral cam mechanism 170 or manually by rotation of the handle 350. An abrupt incremental turning can be effected manually at any time where such turning is deemed necessary to reduce build up of product on the shaft or to allow a more even abrasion of the shaft 30. The shaft 30 can thereby be moved manually to simulate the powered versions and with whatever linear or rotational action is appropriate depending on the situation and is deemed necessary to assist removal of adhering non-magnetic product before the magnetic portion of the shaft before it arrives at the fixed wiping means 110.

Where multiple manual magnetic separators 15F are in use, it may be advantageous to use the spiral cam mechanism 170 or another automatic shaft rotation mechanism.

Figure 17:
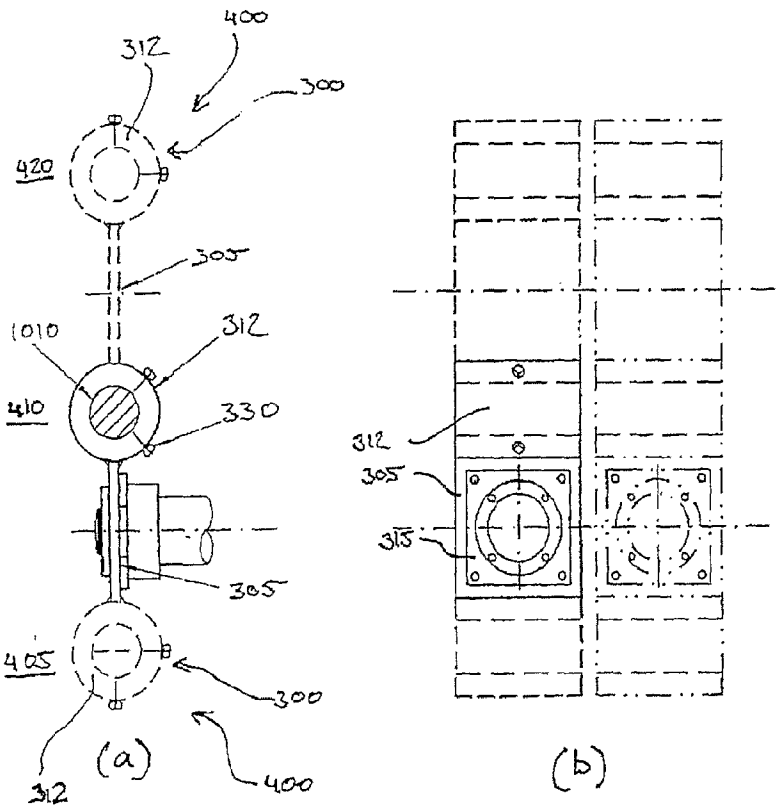
FIG. 17(*a*) is a cross-sectional side view and FIG. 17(*b*) is a rear view of the magnetic separation apparatus of FIG. 15 or 16 mounted on an alternative mounting arrangement shown in phantom lines (except for those parts which are common with the rotatable mount of FIGS. 15 & 16)

Referring to FIG. 17 (*a*), alternative mounting arrangements 400 are shown in phantom lines and comprise a rotatable mount 300 having an extended mount wall 305. In each mounting arrangement 400 the body 312 is located in a different position with respect to the extended mount wall 305, for example, in position 405, 410 or 420. The alternative mounting arrangements 400 advantageously allow multiple rows of magnetic separators (e.g. 15, 15A, 15B, 15C, 15D, 15E or 15F) to be attached thereto or one or more rows of magnetic separators in combination with one or more rows of splitter devices.

FIG. 17 (*b*) shows a rear view of one of the mounting arrangements 400 having a body 312 in the position 410 and showing the mount wall 305 and flange 315. FIG. 17 (*b*) also shows that other expanded alternative mounting arrangements may be provided, for example, with multiple columns one of the mounting arrangements 400 described above.

Figure 18:
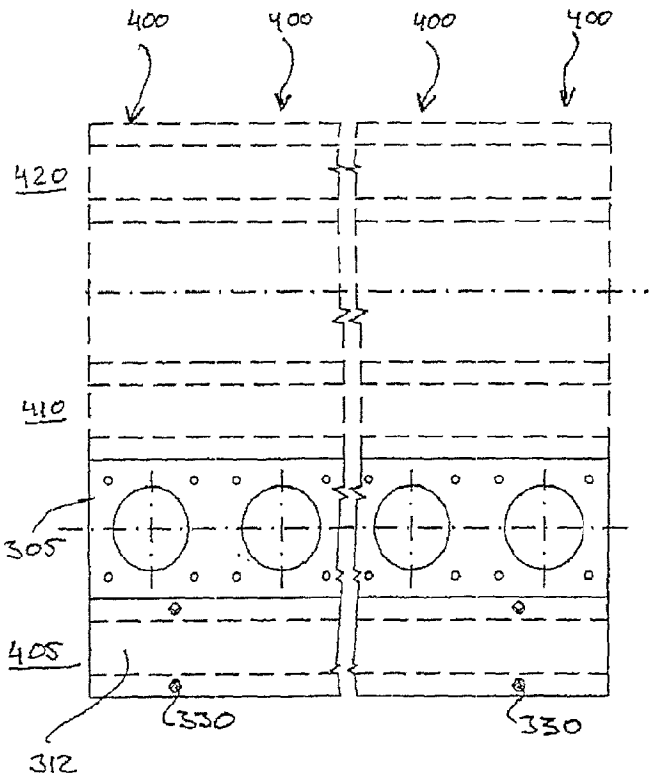
FIG. 18 is a front view of the alternative mounting arrangement of FIG. 17 shown in phantom lines (except for those parts which are common with the rotatable mount of FIGS. 15 & 16).

Referring to FIG. 18, one such expanded alternative mounting arrangement is shown having more than four columns of one of the mounting arrangements 400 in side-by-side relation. The mounting arrangements 400 in FIG. 18 have bodies 312 that are located in the position 405.

Referring to FIGS. 17 (*a*), (*b*) and 18, the mount wall 305 can be a continuous fabricated or extruded plate adapted to receive one or more magnetic separators 15. Preferably, however, the mount walls 305 are individual and can be connected in a modular fashion.

Preferably, the continuous or individual mount walls 305 are fitted with a continuous body 312 that takes the form of a support bush located at the top or the bottom of the mount wall 305 or indeed at both the top and bottom of the mount wall 305. The mount wall 305 can be extended to allow attachment of an additional top cylinder 20 or splitter shaft 29.

Alternatively, two or more smaller bushes or shaft collars (not shown) can be welded to the top and/or bottom of each mount wall 305 to enable sideway adjustment of the separation shaft in relation to the flow so as to centre it in the flow or in the case of two or more magnetic shafts 30 using individual mount walls 305 to enable them to be at varying spaces or centres in relation to each other. The mount wall support bush or bushes 425 are slidingly mounted on a fixed bar(s) 1010 attached to a surrounding structure. When the desired operating position of the magnetic shaft 30 has been determined, the mount wall 305 is locked in place using robust set screws 330. The individual or continuous mount walls 305 with a top or bottom bushing 425 can enable inclination or declination of the separation shaft in a material flow.

The individual mount walls 305 can also enable consecutive separation shafts 30 to be declined or inclined in relation to each other providing an easier passage for difficult to flow materials or materials with lumps bigger than the spaces between bars when at their normal centres when all the bars are in the one plane.

The mount wall 305 as so described is useful to the applications of the magnetic separation apparatus 10 in open product flow situations.

With reference to FIGS. 11, 13, 17 & 18, where an array of two or more magnetic separators 15, or equivalent devices, are provided, splitter bars 28 or splitter shafts 29 may also be provided to save space or reduce the cost of having a top row of one or more magnetic shafts 30 functioning as splitters. Splitter bars 28 and splitter shafts 29 deflect product to provide more surface contact with the succeeding level of two or more magnetic shafts 30.

In one configuration, the splitter bars 28 can be smaller diameter non magnetic bars replaceably mounted between the separation wall 55 and the second wall 202 or between the mount wall 305 and the second wall 202. The splitter bars 28 are fixed above and equidistant to the two or more magnetic shafts 30 situated below.

In some cases, cleaning of fixed splitter bars 28 may be difficult or unsanitary. In such cases, one or more rows of magnetic shafts 30 can be replaced by lower cost, completely non-magnetic splitter shafts 29. It should be noted that the splitter shafts 29 can be cleaned, retracted, extended and rotated in the same manner as magnetic shafts 30 and can be used with either a housing (e.g. as in FIG. 2) or without a housing (e.g. as in FIG. 15).

Where a splitter shaft 29 has been installed, it can be readily removed from the piston 25, cylinder 20 or supporting cylinder 320 and a magnetic shaft 30 can be attached in its place to function as both a splitter and for magnetic separation purposes. For example, for increased magnetic fragment extraction efficiency in particular of paramagnetic contamination of low magnetic susceptibility which requires more as well as intimate contact with the magnetic surface for effective extraction.

In yet another embodiment, each separator 15 has a magnetic shaft 30 and a disc that is adapted to cover the separation wall aperture 75 from the inside to prevent contaminants from entering the magnetic material collection section 60.

In this specification, the term "magnetic shaft" is used to refer to any elongate member that can attract materials on the basis of magnetism and includes a tube having one or more magnets disposed therein.

In this specification, the terms "material flow" and "materials" include products of materials within their scope, in addition to raw materials. Such materials or products may be free flowing, powdery, lumpy, abrasive, food ingredients, grain, chemical or liquids, including material free falling by gravity or being discharged from a pump through an outlet.

While the invention has been described with reference to a number of preferred embodiments it should be appreciated that the invention can be embodied in many other forms.

In one embodiment, each magnetic shaft 30 is replaced with a splitter shaft for directing a material flow.

In another embodiment, other shaft cleaning means may be provided such as brushes or a liquid spray and the cleaning means may be adapted to provide continuous cleaning in use.

In yet another embodiment, in fact the primary invention on which other embodiments are based, the magnetic separation apparatus is a stand-alone apparatus that is not adapted for fitment to a housing but is a fully functional self cleaning magnetic separator in its own right.

Figure 19:
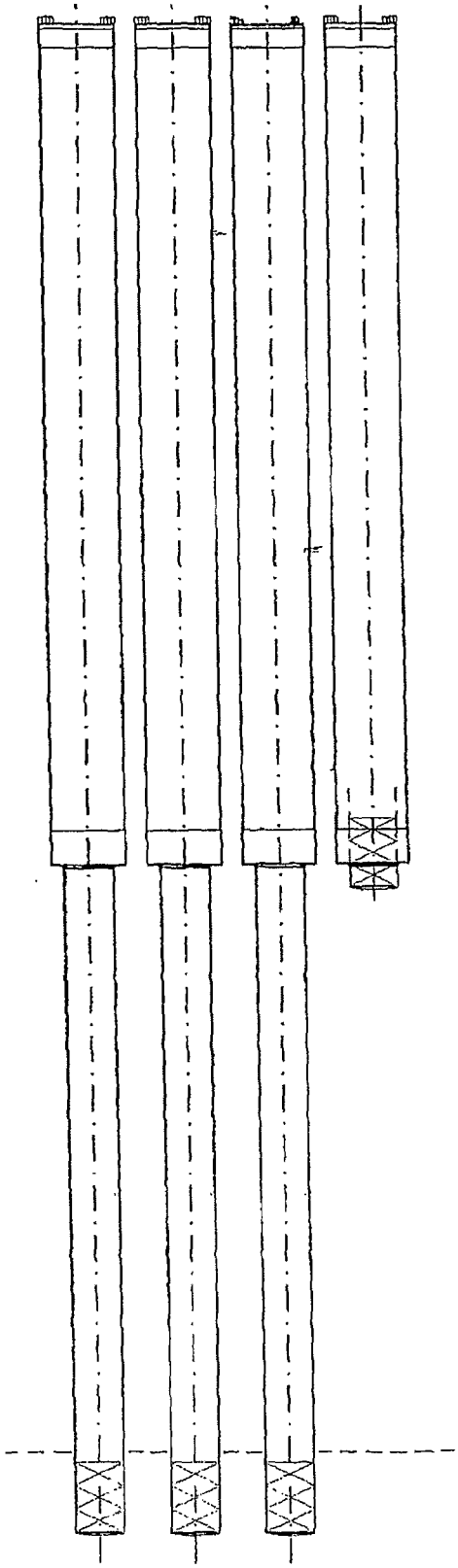
FIG. 19 is a top view of the primary magnetic separation apparatus shown as an array of functional self cleaning magnetic separation modules.
Figure 20:
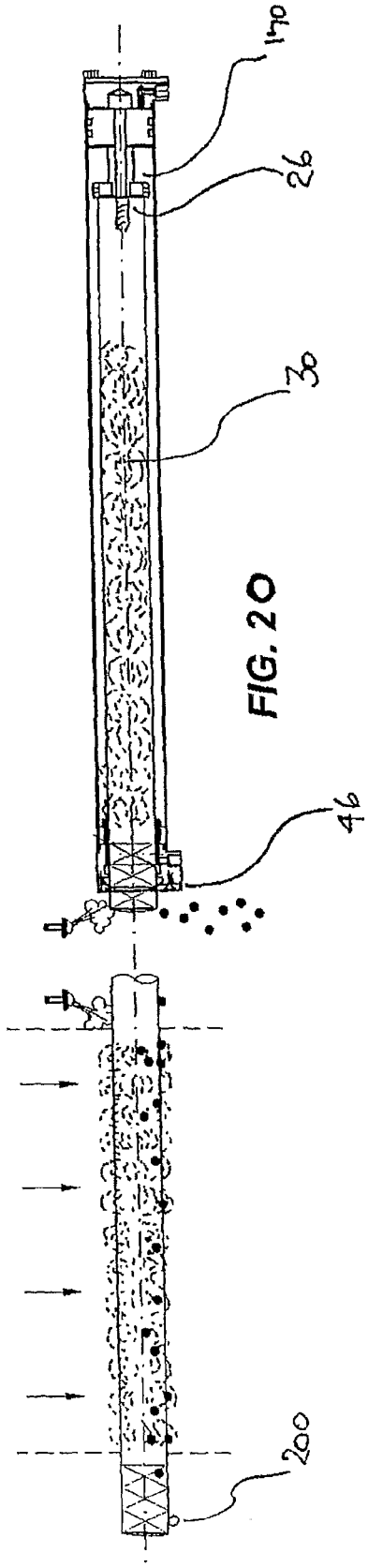
FIG. 20 is a side view of the primary self cleaning magnetic separation module of the magnetic separation apparatus which is fully functional as free standing without a housing.

In this embodiment FIG. 19 shows an array of separate such modules. FIG. 20 shows the module with specific reference to the releasable but self tightening attachment of magnetic shaft 30 to piston 26 and rotation means 70.

FIG. 20 is also shown with particular reference to the attached cylinder 20 end cover washer 46 which protects the end cap and wiper of the cylinder 20 when used in this embodiment.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

The claim defining the invention are as follows:

1. A magnetic separation apparatus for separating magnetic materials from non-magnetic materials in a material flow, the apparatus comprising a housing providing a materials flow section through which material passes, and at least one magnetic separator, each magnetic separator comprising:

a cylinder, having a first end and a second end, the first end being closer to the material flow than the second end in use, a piston movably mounted within the cylinder, and a magnetic shaft having a longitudinal axis and extending from the piston and having an outer surface, a proximal end and a distal end, a rotation device operatable to incrementally rotate the magnetic shaft about the shaft longitudinal axis, the piston being adapted to move the magnetic shaft between a retracted position at which the magnetic shaft is substantially wholly disposed within the cylinder, and an extended position at which the magnetic shaft extends from the cylinder first end, wherein in the extended position, at least a portion of the magnetic shaft outer surface is exposed in said housing to the material flow.

2. The magnetic separation apparatus as claimed in claim 1, wherein the apparatus comprises a plurality of magnetic separators, each magnetic separator being operable independently of the other magnetic separators in moving their respective magnetic shaft between its extended and retracted positions.

3. The magnetic separation apparatus as claimed in claim 2, wherein the magnetic separators are arranged such that the magnetic shafts are substantially parallel to each other and/or located in the same plane.

4. The magnetic separation apparatus as claimed claim 2, further comprising a support to which each cylinder is mounted, the support having a first wall separating the cylinder of each magnetic separator from the material flow in use, the first wall having a respective aperture for the magnetic shaft of each magnetic separator such that each magnetic shaft extends through its respective support aperture as it moves between the retracted and extended positions.

5. The magnetic separation apparatus as claimed in claim 4, further comprising a cleaning means for removing magnetic material attracted to the outer surface of each magnetic shaft.

6. The magnetic separation apparatus as claimed in claim 5, wherein the cleaning means removes the magnetic material during movement of each magnetic shaft from its extended position to its retracted position.

7. The magnetic separation apparatus as claimed in claim 5, wherein the cleaning means comprises a wiping lip for each shaft, each wiping lip defining a wiping aperture through which the respective shaft extends, the wiping aperture being dimensioned such that the wiping lip engages the outer surface of the magnetic shaft, wherein magnetic material adhered to the outer surface of the shaft is substantially wiped off the shaft by the wiping lip causing the magnetic material to fall as the magnetic shaft moves to its retracted position, wherein each cleaning means is fixed or magnetically attracted to the first wall.

8. The magnetic separation apparatus as claimed in claim 4, wherein the support defines a housing having said first wall, the housing defining a material flow section and a magnetic materials collection section disposed between the material flow section and the first wall.

9. The magnetic separation apparatus as claimed in claim 8, further comprising a separation wall separating the magnetic materials collection section from the material flow section, the separation wall having a respective separation wall aperture for the shaft of each magnetic separator such that each magnetic shaft extends through its respective separation wall aperture as it is moved between the retracted and extended positions.

10. The magnetic separation apparatus as claimed in claim 9, further comprising a cleaning means for removing magnetic material attracted to the outer surface of each magnetic shaft, and wherein the cleaning means is located within or adjacent to the magnetic materials collection section.

11. The magnetic separation apparatus as claimed in claim 10, wherein the cleaning means comprises a wiping lip for each shaft, each wiping lip defining a wiper aperture through which the respective shaft extends, the wiper aperture being dimensioned such that the wiping lip engages the outer surface of the magnetic shaft, wherein magnetic material adhered to the outer surface of the shaft is substantially wiped off the shaft by the wiping lip causing the magnetic material to fall as the magnetic shaft moves to its retracted position.

12. The magnetic separation apparatus as claimed in claim 11, further comprising a wiper supporting ring disposed around the wiping lip, wherein each wiper supporting ring is larger than the respective housing and separation wall apertures of the respective shaft, such that as each shaft is moved to its extended position, its respective wiping means moves with the shaft until the wiper supporting ring abuts the separation wall, whereupon the shaft slides through the respective wiper aperture and into the material flow section, and as each shaft is moved to its retracted position, its respective wiping means moves with the shaft until the wiper supporting ring abuts the first wall, whereupon the shaft slides through the respective wiper aperture and into the cylinder.

13. The magnetic separation apparatus as claimed in claim 12, wherein the wiper supporting ring substantially seals the magnetic materials collection section from the material flow section when the wiper supporting ring abuts the separation wall.

14. The magnetic separation apparatus as claimed claim 9, wherein the distal end of each shaft has a disc removably fitted thereto, such that when the shaft is in the retracted position, the disc extends across and closes its respective separation wall aperture.

15. The magnetic separation apparatus as claimed in claim 5, wherein the cleaning means comprises a pressurised gas delivery means, the pressurised gas delivery means having at least one output nozzle for directing pressurised gas at the outer surface of each magnetic shaft, and a respective gas duct for conveying pressurised gas to each nozzle.

16. The magnetic separation apparatus as claimed in claim 15, wherein at least one of the gas ducts conveys pressurised gas expelled from one of the cylinders during movement of the shaft between its extended and retracted positions.

17. The magnetic separation apparatus as claimed in claim 15, wherein at least one of the gas ducts conveys pressurised gas from an external pressurised gas source.

18. The magnetic separation apparatus as claimed in claim 1, wherein the rotation device is adapted to rotate the magnetic shaft by an angular increment during movement of the shaft from its extended position to its retracted position and/or from its retracted position to its extended position.

19. The magnetic separation apparatus as claimed in claim 1, wherein the rotation device is a cam mechanism comprising a cam engagement means disposed on the outer surface of the magnetic shaft, and a cam track disposed within the respective cylinder, wherein the shaft is movable longitudinally relative to the cam engagement means, the cam engagement means being rotatable in a first rotation direction relative to the magnetic shaft and being rotationally fixed relative to the magnetic shaft in an opposite second direction, the cam engagement means adapted to engage the cam track, such that during movement of the magnetic shaft between its retracted and extended positions, the cam engagement means is engaged by the cam track for a predetermined period toward the second direction which causes the magnetic shaft to rotate by an angular increment in the same direction as the cam track.

20. The magnetic separation apparatus as claimed in claim 2, further comprising a respective shaft support means for supporting the weight of each shaft when in the extended position.

21. The magnetic separation apparatus as claimed in claim 20, wherein the shaft support means comprises a transverse support bar that supports the distal end of the shaft.

22. The magnetic separation apparatus as claimed in claim 2, wherein a distal region of each shaft is non-magnetic.

23. A method of separating magnetic materials from non-magnetic materials in a material flow using a magnetic separator having a housing providing a materials flow section through which materials pass, and a cylinder, a piston movably mounted within the cylinder and a magnetic shaft having a longitudinal axis and extending from the piston, the piston being adapted to move the magnetic shaft between a retracted position at which the magnetic shaft is substantially wholly disposed within the cylinder, and an extended position at which the magnetic shaft extends out of the cylinder, the method including the steps of:

extending the magnetic shaft into the material flow via the piston such that at least a portion of the magnetic shaft outer surface is exposed to the material flow; and retracting the magnetic shaft from the material flow into the cylinder and causing rotation of the shaft about the shaft longitudinal axis.

24. The method of separating magnetic materials from non-magnetic materials in a material flow as claimed in claim 23, further comprising the step of:

wiping the magnetic shaft as it is being retracted into the cylinder to substantially remove any magnetic material adhered to its outer surface.

25. The method of separating magnetic materials from non-magnetic materials in a material flow as claimed in claim 23, further comprising the step of:

rotating the magnetic shaft along its longitudinal axis by an angular increment as it is being extended and/or retracted.

* * * * *